US009442419B2

(12) United States Patent
Wakabayashi et al.

(10) Patent No.: US 9,442,419 B2
(45) Date of Patent: Sep. 13, 2016

(54) DEVELOPING APPARATUS, DEVELOPING METHOD, IMAGE FORMING APPARATUS, AND IMAGE FORMING METHOD

(71) Applicant: CANON KABUSHIKI KAISHA, Tokyo (JP)

(72) Inventors: Kazuhito Wakabayashi, Mishima (JP); Masaki Yamada, Mishima (JP); Minoru Ito, Susono (JP); Tomoya Uesugi, Susono (JP); Michihisa Magome, Mishima (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/571,683

(22) Filed: Dec. 16, 2014

(65) Prior Publication Data

US 2015/0185658 A1 Jul. 2, 2015

(30) Foreign Application Priority Data

Dec. 26, 2013 (JP) ..... 2013-270545

(51) Int. Cl.

| | |
|---|---|
| ***G03G 15/08*** | (2006.01) |
| ***G03G 5/10*** | (2006.01) |
| ***G03G 5/147*** | (2006.01) |
| ***G03G 9/097*** | (2006.01) |

(52) U.S. Cl.

CPC ..... *G03G 15/0818* (2013.01); *G03G 5/102* (2013.01); *G03G 5/14708* (2013.01); *G03G 9/09725* (2013.01)

(58) Field of Classification Search

CPC ..... G03G 15/0818; G03G 9/00

USPC ..... 430/105; 399/111, 286

See application file for complete search history.

(56) References Cited

U.S. PATENT DOCUMENTS

| | | | |
|---|---|---|---|
| 7,361,442 | B2 | 4/2008 | Otake et al. |
| 7,796,926 | B2 | 9/2010 | Matsuda et al. |
| 8,538,303 | B2 | 9/2013 | Matsuda et al. |
| 8,883,389 | B2 | 11/2014 | Matsui et al. |
| 2015/0185643 | A1 | 7/2015 | Magome et al. |
| 2015/0185657 | A1 | 7/2015 | Matsui et al. |

FOREIGN PATENT DOCUMENTS

| | | | |
|---|---|---|---|
| JP | 57-5047 | A | 1/1982 |
| JP | 2004-333682 | A | 11/2004 |

*Primary Examiner* — Thorl Chea

(74) *Attorney, Agent, or Firm* — Fitzpatrick, Cella, Harper & Scinto

(57) ABSTRACT

A developing apparatus and a developing method that significantly suppress generation of fogging and form a high-quality electrophotographic images under any environments such as a high temperature and high humidity environment and a low temperature and low humidity environment are provided.

A toner wherein a covering rate X1 of the surface of a toner particle with silica fine particles, which is determined by ESCA, is 40.0 to 75.0 area %, and the diffusion index represented by (Expression 1) diffusion index=X1/X2 satisfies (Expression 2) diffusion index≥−0.0042×X1+0.62 where in the theoretical covering rate with the silica fine particles is defined as X2; and a developing apparatus including a developing carrying member which is a surface layer formed of a urethane resin having a partial structure derived from a reaction of a polyisocyanate with a compound represented by Formula 1.

6 Claims, 4 Drawing Sheets

DEVELOPING APPARATUS, DEVELOPING METHOD, IMAGE FORMING APPARATUS, AND IMAGE FORMING METHOD

BACKGROUND OF THE INVENTION

1. Field of the Invention

The present invention relates to a developing apparatus, a developing method, an image forming apparatus, and an image forming method using electrophotography.

2. Description of the Related Art

Higher quality of electrophotographic images has been required, and suppression of generation of "fogging" caused by toners adhering to non-image portions of electrophotographic images has been required.

A reduction in size of image forming apparatuses using electrophotography has been required by users in the market.

One of methods for achieving the reduction in size is systems (hereinafter also referred to as a "cleaner-less system") without a cleaner for removing toners remaining on the surfaces of electrophotographic photosensitive members, such as cleaning blades, (hereinafter also simply referred to as a "cleaner"). Unfortunately, in the cleaner-less system, the role of the cleaner needs to be complemented by another member.

Namely, the image forming apparatuses employing the cleaner-less system have no cleaner for the electrophotographic photosensitive member, and the charging member may be contaminated by a toner adhering to the charging member if the toner adheres to non-developed portions in the electrophotographic photosensitive member, such as portions in which no electrostatic latent image is formed, and are not transferred onto paper. Accordingly, to suppress contamination of the charging member, the developing apparatus should more significantly suppress adhesion of the toner to non-developed portions in the electrophotographic photosensitive member (hereinafter also referred to as "fogging"). The adhesion of the toner to non-image portions is caused by a developer carried on a developing carrying member if the developer contains part of the toner charged at a polarity opposite to a target polarity (hereinafter also referred to as "reverse toner") and part of the toner having an absolutely insufficient charge amount although charged at a target polarity.

Japanese Patent Application Laid-Open No. 2004-333682 suggests a developing carrying member including a positive-charging resin layer to enhance a negative charging ability to a toner.

The present inventors have examined and found that the developing carrying member described in Japanese Patent Application Laid-Open No. 2004-333682 can sufficiently negatively charge the toners even under a high temperature and high humidity environment in particular in which the charge amount of the toner readily become insufficient.

Unfortunately, such a developing carrying member will provide an excessive charge amount of the toner (charge up) under a low temperature and low humidity environment. In this case, the charged up toner adheres to the surface of the developing carrying member, preventing a toner newly fed to the developing carrying member from being sufficiently charged. Such a toner having an insufficient charge amount may cause fogging.

Moreover, a toner and paper powder adhering onto the electrophotographic photosensitive member may cause insufficient Vback to generate defects in electrophotographic images. If the Vback is increased to prevent this phenomenon, the reverse toner more readily adheres to non-developed portions to cause more fogging.

SUMMARY OF THE INVENTION

To solve the problems described above, the present invention is directed to providing a developing apparatus and a developing method that can form high-quality electrophotographic images under a variety of environments.

Further, the present invention is directed to providing an image forming apparatus and an image forming method that can form high-quality electrophotographic images under a variety of environments.

According to one aspect of the present invention, there is provided a developing apparatus comprising: a toner, a developing container accommodating the toner, a developing carrying member rotatably held, the developing carrying member carrying the toner fed from the developing container on the surface of the developing carrying member to form a toner layer and conveying the toner layer, and a toner layer thickness controlling member controlling the thickness of the toner layer, wherein the toner contains toner particles containing a binder resin and a colorant, and silica fine particles, a covering rate X1 of the surface of each of the toner particles covered with the silica fine particles determined by an X-ray electron spectroscope for chemical analysis (ESCA) is 40.0 area % or more and 75.0 area % or less, a diffusion index represented by Expression 1 satisfies Expression 2, $$\text{diffusion index}=X1/X2 \quad \text{(Expression 1)}$$

$$\text{diffusion index} \geq -0.0042 \times X1+0.62, \quad \text{(Expression 2)}$$

where a theoretical covering rate with the silica fine particles is defined as X2; the developing carrying member includes a substrate, an elastic layer, and a surface layer containing a urethane resin, the urethane resin has a partial structure derived from a reaction of a polyisocyanate with a compound represented by Formula (1):

Formula (1)

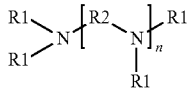

wherein n is an integer of 1 or more and 4 or less, and R1 is each independently any one selected from the group consisting of (a) to (c):

(a) a hydroxyalkyl group having 1 or more and 8 or less carbon atoms, (b) an aminoalkyl group having 2 or more and 8 or less carbon atoms, and (c) a group represented by Formula (2):

Formula (2)

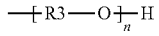

wherein m represents an integer of 2 or more and 3 or less, and R3 represents an alkylene group having 2 or more and 5 or less carbon atoms, and R2 is an alkylene group having 2 or more and 4 or less carbon atoms.

According to another aspect of the present invention, there is provided a developing method including a step of conveying a toner with a developing carrying member to a region to be developed in an electrostatic latent image carrying member on which an electrostatic latent image is formed, and developing the electrostatic latent image with the toner in the region to be developed, wherein the toner contains toner particles containing a binder resin and a colorant, and silica fine particles, a covering rate X1 of the surface of each of the toner particles covered with the silica fine particles determined by an X-ray electron spectroscope for chemical analysis (ESCA) is 40.0 area % or more and 75.0 area % or less, a diffusion index represented by Expression 1 satisfies Expression 2, $$\text{diffusion index}=X1/X2 \quad \text{(Expression 1)}$$

$$\text{diffusion index} \geq -0.0042 \times X1+0.62, \quad \text{(Expression 2)}$$

where a theoretical covering rate with the silica fine particles is defined as X2; the developing carrying member includes a substrate, an elastic layer, and a surface layer containing a urethane resin, and the urethane resin has a partial structure derived from a reaction of a polyisocyanate with a compound represented by Formula (1):

Formula (1)

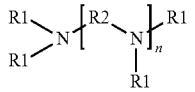

wherein n is an integer of 1 or more and 4 or less,

R1 is each independently any one selected from the group consisting of (a) to (c): (a) a hydroxyalkyl group having 1 or more and 8 or less carbon atoms, (b) an aminoalkyl group having 2 or more and 8 or less carbon atoms, (c) a group represented by Formula (2):

Formula (2)

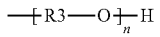

wherein m represents an integer of 2 or more and 3 or less, and R3 represents an alkylene group having 2 or more and 5 or less carbon atoms, and R2 represents an alkylene group having 2 or more and 4 or less carbon atoms.

According to further aspect of the present invention, there is provided an image forming apparatus including an image bearing member, a developing apparatus developing an electrostatic latent image formed on the image bearing member, wherein the developing apparatus is the developing apparatus described above.

According to further aspect of the present invention, there is provided an image forming method including: a charging step of applying voltage to a charging member to charge an image bearing member, a latent image forming step of forming a latent image on the charged surface of the image bearing member, a developing step of developing the electrostatic latent image with a toner carried on a developing carrying member to form a toner image, and a transferring step of transferring the toner image onto a recording medium, wherein the developing step includes the developing method described above.

Further features of the present invention will become apparent from the following description of exemplary embodiments with reference to the attached drawings.

DESCRIPTION OF THE EMBODIMENTS

Figure 1:
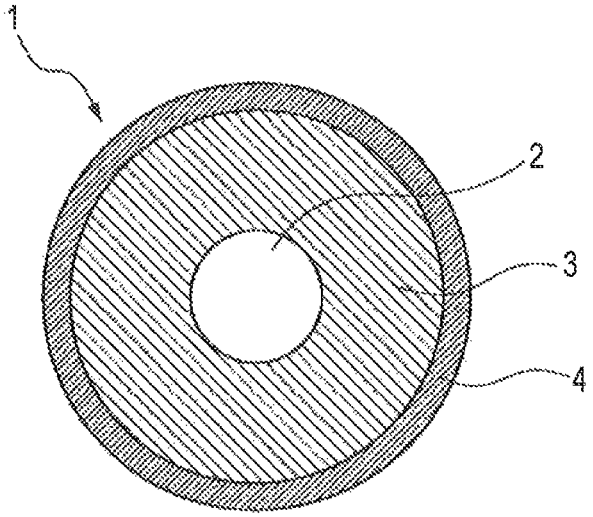
FIG. 1 is a schematic configuration diagram illustrating an example of a developing carrying member according to the present invention.

Preferred embodiments of the present invention will now be described in detail in accordance with the accompanying drawings.

The present inventors, who have conducted extensive research, have found that a combination of a specific developing carrying member and a specific toner can suppress generation of fogging under a variety of environments such as a high temperature and high humidity environment and a low temperature and low humidity environment.

The reasons will now be described.

First, fogging under a high temperature and high humidity environment will be described. To attain uniform charging properties under a high temperature and high humidity environment in which the toner is difficult to charge, the developing carrying member needs to have high charging properties and such surface properties that the toner rolls well. The toner contacts the developing carrying member and is charged by friction. Then, the present inventors have examined various compounds contained in the surface layer of the developing carrying member, and have found that a compound represented by Formula (1) has high charging properties. The reason is as follows. The compound represented by Formula (1) has a nitrogen atom (N) in the center thereof. The nitrogen atom has an unshared electron pair (lone pair). Accordingly, the compound represented by Formula (1) is a Lewis base. Since a Lewis base is electron donating, the toner can be charged quickly by contacting the compound represented by Formula (1).

Moreover, the compound represented by Formula (1) reacts with an isocyanate to form a crosslinking structure in which a large number of urethane groups or urea groups are generated around the structure of the compound represented by Formula (1). As a result, the micro hardness of the surface layer is increased. When the toner is controlled in a contact portion between the developer controlling member and the developing carrying member (hereinafter also referred to as a control portion), the toner barely gets into the surface of the developing carrying member, and high rolling properties of the toner can be maintained.

Generally, in low molecular weight and polyfunctional compounds, steric hindrance causes difficulties in reaction of all of the functional groups. The compound represented by Formula (1), however, has high reactivity of a terminal hydroxyl group or a terminal amino group due to the amino skeleton in the molecule, and barely generates non-reacted components. For this reason, charging uniformity can be enhanced more significantly and the uniformity of the crosslinking structure can be enhanced.

Next, for fogging under a low temperature and low humidity environment, the developing carrying member used in the present invention, which has a compound represented by Formula (1) on the surface layer thereof, has high charging properties. These high charging properties are also demonstrated under a low temperature and low humidity environment, and the charge amount of the toner will be large. In particular, if a state where development of the toner is not performed in non-image regions (hereinafter referred to as formation of a white solid image) continues, the toner is not circulated in the control portion, leading to a significantly large charge amount of the toner stagnating in the control portion. As a result, an image force is unintendedly increased to cause a phenomenon such that the toner adheres onto the developing carrying member. In such a state, in particular, friction of the toner fed to the developing carrying member immediately after development (hereinafter referred to as formation of a black solid image) with the surface of the developing carrying member is significantly reduced, leading to an insufficient charge amount of the toner. The toner having an insufficient charge amount causes fogging (particularly referred to as fogging after formation of a black solid image).

Against the phenomenon, the toner should be circulated in the control portion of the developing carrying member. If the toner is well circulated, adhesion of the toner onto the developing carrying member can be suppressed to prevent generation of fogging under a low temperature and low humidity environment. For this purpose, it is important that the toner has a covering rate X1 of the surface of the toner particle with silica fine particles of 40.0 area % or more and 75.0 area % or less, which is determined with an X-ray electron spectroscope for chemical analysis (ESCA), and the diffusion index represented by (Expression 1) satisfies (Expression 2) where the theoretical covering rate with the silica fine particles is defined as X2.

$$\text{diffusion index}=X1/X2 \quad \text{(Expression 1)}$$

$$\text{diffusion index}\geq -0.0042\times X1+0.62 \quad \text{(Expression 2)}$$

As a result, a developing apparatus can be attained which can significantly suppress generation of fogging to form high-quality electrophotographic images under a high temperature and high humidity environment and under a low temperature and low humidity environment.

<Developing Apparatus and Image Forming Apparatus>

Next, the developing apparatus according to the present invention and the image forming apparatus will be described according to the drawings, but the present invention will not be limited to these.

Figure 2:
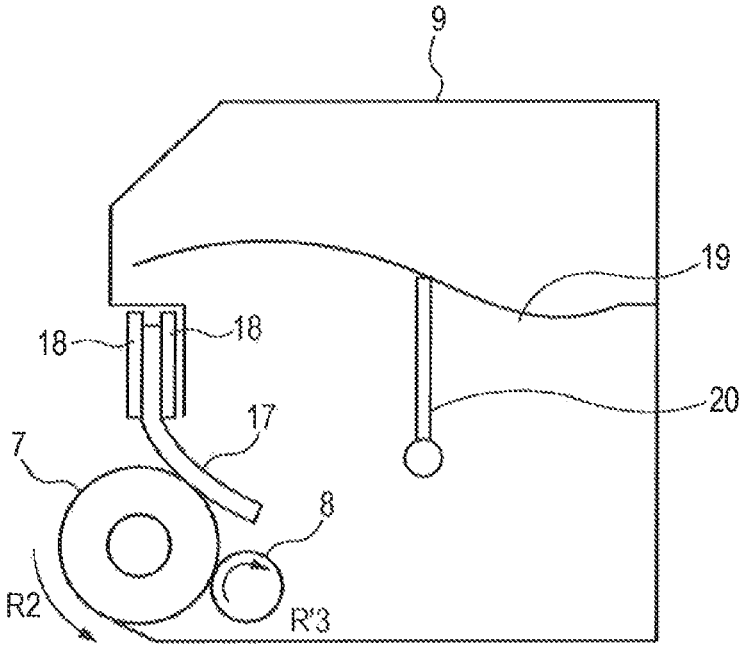
FIG. 2 is a schematic configuration diagram illustrating an example of a developing apparatus according to the present invention.
Figure 3:
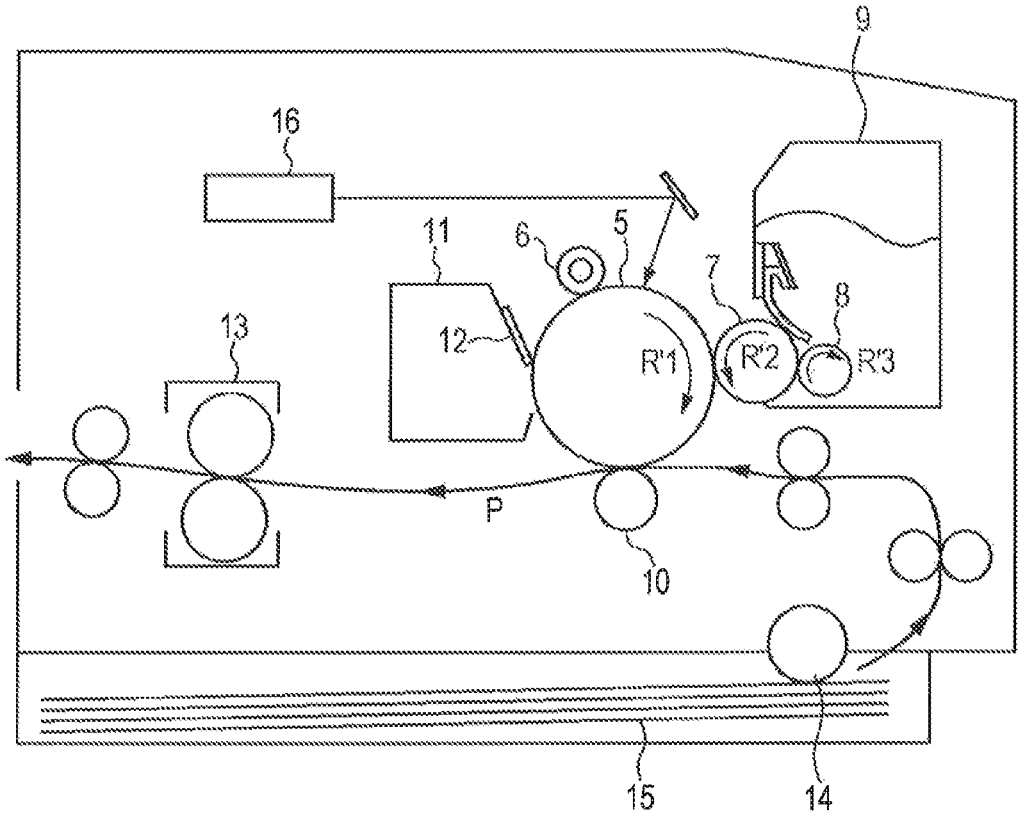
FIG. 3 is a schematic configuration diagram illustrating an example of an image forming apparatus according to the present invention.

FIG. 2 is a schematic configuration diagram illustrating an example of the developing apparatus according to the present invention. FIG. 3 is a schematically cross sectional diagram illustrating an example of an image forming apparatus including the developing apparatus according to the present invention.

In FIG. 2 or FIG. 3, an electrostatic latent image carrying member 5 is rotatably held and rotated in the direction of an arrow R'1. The electrostatic latent image carrying member 5 is an image bearing member on which an electrostatic latent image is formed. A developing carrying member 7 rotates in the direction of an R'2 to convey a toner 19 to a region to be developed in which the developing carrying member 7 faces the electrostatic latent image carrying member 5. The developing carrying member is in contact with a toner feeding member 8 which feeds the toner 19 to the surface of the developing carrying member.

A charging member (charging roller) 6, a transfer member (transfer roller) 10, a cleaner container 11, a cleaning blade 12, a fixing unit 13, a pick up roller 14, and the like are provided around the electrostatic latent image carrying member 5. The electrostatic latent image carrying member 5 is charged by the charging roller 6. The electrostatic latent image carrying member 5 is irradiated with laser light from a laser generating apparatus 16 to perform exposure. This forms an electrostatic latent image corresponding to a target image on the charged surface of the electrostatic latent image carrying member. The electrostatic latent image on the electrostatic latent image carrying member is developed with the toner in the developing unit 9 to form a toner image. The toner image is transferred onto a transfer material (paper) 15 by a transfer member (transfer roller) 10, which contacts the electrostatic latent image carrying member 5 with the transfer material being interposed. The transfer material (paper) 15 carrying the toner image is conveyed to the fixing unit 13, and the toner image is fixed on the transfer material (paper) 15. The toner 19 partially remaining on the electrostatic latent image carrying member 5 is scraped with a cleaning blade 12, and is accommodated in the cleaner container 11.

A charging step in the developing apparatus according to the present invention can use a contact charging apparatus in which the electrostatic latent image carrying member and the charging roller form a contact region and contact each other, and a predetermined charge bias is applied to the charging roller to charge the surface of the electrostatic latent image carrying member to a predetermined polarity and potential. Such contact charging can stably and uniformly charge the surface of the electrostatic latent image carrying member and can reduce generation of ozone. To keep the contact with the electrostatic latent image carrying member uniform and perform uniform charging, a charging roller rotating in the same direction as the electrostatic latent image carrying member can be used.

Examples of materials for the charging roller include, but should not be limited to, rubber materials such as materials for elastic members (such as ethylene-propylene-diene polyethylene (EPDM), urethane, butadiene acrylonitrile rubber (NBR), silicone rubber, and isoprene rubber) in which a conductive substance such as carbon black and metal oxide is dispersed to adjust resistance, and foamed products thereof. An ionic conductive material without any conductive substance dispersed or in combination with a conductive substance can be used to adjust resistance.

Examples of a core metal used in the charging roller include aluminum and SUS. The charging roller is arranged to be pressed against the elasticity of a charged member, i.e., an electrostatic latent image carrying member at a predetermined pressure to form a contact charging region which is a contact region between the charging roller and the electrostatic latent image carrying member.

Next, examples of the contact transferring step which can be used in the developing apparatus according to the present invention include a step of electrostatically transferring the toner image onto a recording medium while a voltage having a polarity opposite to that of the toner is applied to the transfer member and the electrostatic latent image carrying member is in contact with the transfer member through the recording medium.

In the present invention, the toner layer thickness controlling member can contact the developing carrying member through the toner to control the thickness of the toner layer on the developing carrying member. The toner layer thickness controlling member contacting the developing carrying member is typically a control blade, which can be suitably used in the present invention.

The control blade usable in the present invention may be a rubber elastic member formed of, for example, silicone rubber, urethane rubber, or NBR; a synthetic resin elastic member formed of, for example, polyethylene terephthalate; a metal elastic member such as a phosphor bronze plate and an SUS plate; and a composite member thereof. Alternatively, a control blade formed of an elastic support such as a rubber, synthetic resin, or metal elastic member and a charge controlling substance such as resin, rubber, metal oxide, or metal applied onto the support so as to contact the contact region with the developing carrying member may be used. The charge controlling substance is applied to control the charging properties of the toner. Among these, control blades including metal elastic members and a resin or rubber bonded thereto so as to contact the contact region with the developing carrying member are particularly preferred.

The material for the member bonded to the metal elastic member can be those readily charged at a positive polarity, such as urethane rubber, urethane resin, polyamide resin, and nylon resin.

The base of the control blade, which is an upper portion thereof, is held on the side of the developing unit. A lower portion of the blade is bent against its elastic force in the forward direction or opposite direction of the developing carrying member to contact the surface of the developing carrying member at a proper elastic pressure.

The contact pressure between the control blade and the developing carrying member is preferably 1.27 to 245.00 N/m (3 to 250 g/cm), more preferably 4.9 to 118.0 N/m (5 to 120 g/cm) in terms of a line pressure in the direction of a generating line of the developing carrying member. The contact pressure in this range is effective. At a contact pressure of less than 1.27 N/m, the toner is difficult to uniformly apply, causing fogging or scattering. At a contact pressure of more than 245 N/m (250 g/cm), a great pressure is applied to the toner to readily degrade the toner.

The amount of the toner layer on the developing carrying member is preferably 2.0 $g/m^2$ or more and 12.0 $g/m^2$ or less. The amount is more preferably 3.0 $g/m^2$ or more and 10.0 $g/m^2$ or less.

At an amount of the toner on the developing carrying member of less than 2.0 $g/m^2$, sufficient image density is difficult to attain.

At an amount of the toner on the developing carrying member of more than 12.0 $g/m^2$, defects in control are readily generated, and uniform charging properties are readily impaired to increase fogging.

In the present invention, the amount of the toner on the developing carrying member can be arbitrarily varied by varying the surface roughness (Ra) of the developing carrying member and the free length and the contact pressure of the control blade.

Figure 4:
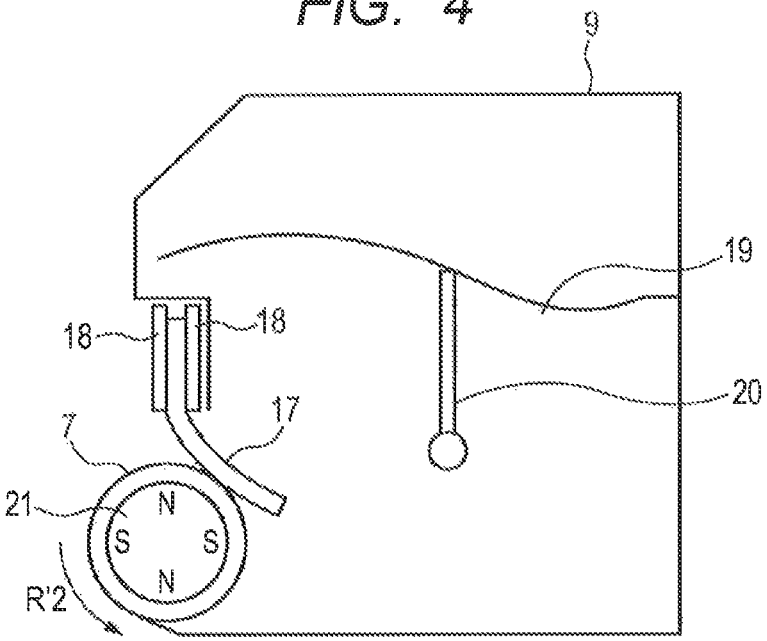
FIG. 4 is a schematic configuration diagram illustrating another example of the developing apparatus according to the present invention.

As illustrated in FIG. 4, a magnet roller having a magnet disposed inside the roller in contact therewith may be arranged inside the developing carrying member to magnetically attract and hold the developer onto the developing carrying member.

The developing carrying member according to the present invention can be used in both of a contact developing system that performs development in contact with a drum and a non-contacting developing system that performs development in non-contact with a drum. In particular, the developing carrying member according to the present invention can be suitably in the contact developing system that performs development in contact with a drum.

To develop the toner carried on the developing carrying member, a developing bias voltage is applied onto the developing carrying member as a biasing method. When DC voltage is applied as the developing bias voltage, a voltage corresponding to the difference between the potential of the image portions (regions visualized by application of the developer) in the electrostatic latent image and the potential of non-image portions (regions having no developer) can be applied to the developing carrying member. The absolute value (Vcontrast) of the difference between the potential of the image portions in the electrostatic latent image and the developing bias potential is preferably in the range of 50 V or more and 400 V or less. At an absolute value in this range, an image having suitable density is formed. To increase the density of the developed image and improve graduation, an alternating bias voltage may be applied to the developing carrying member to form a vibration electric field whose diction alternately reverses, in the region to be developed.

The absolute value (Vback) of the difference between the potential of the non-image portions in the electrostatic latent image and the developing bias potential is preferably in the range of 50 V or more and 600 V or less. At an absolute value in this range, undesirable development of the toner in the non-image portions can be suitably suppressed. Particularly in the cleaner-less system, paper powder adhering onto the drum causes insufficient Vback to readily generate image defects. Moreover, the toner remaining on the drum without being transferred onto the paper should be recovered again in the developing container accommodating the toner. For these reasons, Vback can be set at a higher value. The value can be in the range of 300 V or more and 600 V or less.

Next, the developing carrying member used in the present invention will be described.

The developing carrying member used in the present invention includes a substrate, an elastic layer, and a surface layer containing a urethane resin. The urethane resin has a partial structure derived from a reaction of a polyisocyanate with a compound represented by Formula (1).

One embodiment of the developing carrying member according to the present invention is illustrated in FIG. 1. The developing carrying member 1 illustrated in FIG. 1 includes a cylindrical or hollow cylindrical conductive substrate 2 and an elastic layer 3 disposed on the outer peripheral surface of the substrate 2. The outer peripheral surface of the elastic layer 3 is coated with a surface layer 4.

<Substrate>

The substrate 2 functions as an electrode and a supporting member of the developing carrying member 1, and is composed of a conductive material such as a metal or an alloy (such as aluminum, copper alloy, and stainless steel), iron plated with chromium or nickel, or a conductive synthetic resin.

<Elastic Layer>

The elastic layer 3 allows the developing carrying member to have elasticity needed for formation of a nip with a predetermined width in the contact region between the developing carrying member and the electrostatic latent image carrying member.

Usually the elastic layer 3 can be formed of a molded rubber material. Examples of the rubber material include: ethylene-propylene-diene copolymerization rubber (EPDM), acrylonitrile-butadiene rubber (NBR), chloroprene rubber (CR), natural rubber (NR), isoprene rubber (IR), styrene-butadiene rubber (SBR), fluorine rubber, silicone rubber, epichlorohydrin rubber, hydride of NBR, and urethane rubber. These may be used singly or in combinations of two or more.

Among these, silicone rubber can be used in particular because silicone rubber barely gives compression set to the elastic layer when another member (such as a developer controlling blade) contacts the developing carrying member 1 for a long time. Examples of silicone rubber include cured materials of addition-cured silicone rubber. Furthermore, cured materials of addition cured dimethyl silicone rubber are particularly preferable because these have high adhesiveness to the surface layer described later.

The elastic layer 3 can appropriately contain a variety of additives such as a conductive agent, a non-conductive filler, a conductive filler, a crosslinking agent, and a catalyst. The conductive agent can be fine particles of conductive metals such as carbon black, aluminum, and copper, and conductive metal oxides such as zinc oxide, tin oxide, and titanium oxide. Among these, carbon black is particularly preferred because it is relatively readily available and attains high conductivity. When carbon black is used as the conductive agent, 2 to 50 parts by mass of carbon black is compounded based on 100 parts by mass of rubber in the rubber material. Examples of the non-conductive filler include silica, quartz powder, titanium oxide, zinc oxide, or calcium carbonate. Examples of the crosslinking agent include di-t-butyl peroxide, 2,5-dimethyl-2,5-di(t-butylperoxy)hexane, or dicumyl peroxide.

<Surface Layer>

The surface layer 4 contains a urethane resin. The urethane resin has a partial structure derived from a reaction of a polyisocyanate with a compound represented by Formula (1).

Formula (1)

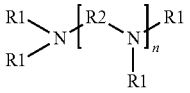

wherein n is an integer of 1 or more and 4 or less; R1 is each independently any one selected from the group consisting of (a) to (c): (a) a hydroxyalkyl group having 1 or more and 8 or less carbon atoms, (b) an aminoalkyl group having 2 or more and 8 or less carbon atoms, and (c) a group represented by Formula (2):

Formula (2)

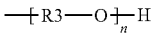

wherein m represents an integer of 2 or more and 3 or less, and R3 represents an alkylene group having 2 or more and 5 or less carbon atoms; and R2 represents an alkylene group having 2 or more and 4 or less carbon atoms.

Such a urethane resin can be synthesized as follows, for example.

First, a polyol component such as polyether polyol and polyester polyol is reacted with a polyisocyanate to prepare an isocyanate group-terminated prepolymer.

Next, the isocyanate group-terminated prepolymer is reacted with the compound having a structure represented by Formula (1) to prepare the urethane resin according to the present invention.

Examples of polyether polyol include polyethylene glycol, polypropylene glycol, and polytetramethylene glycol. Examples of polyester polyol include polyester polyols prepared by condensation reaction of a diol component (such as 1,4-butane diol, 3-methyl-1,4-pentane diol, or neopentyl glycol) and a triol component (such as trimethylolpropane) with a dicarboxylic acid (such as adipic acid, phthalic anhydride, terephthalic acid, or hexahydroxyphthalic acid).

Examples thereof polyether polyol also include polyolefin polyol such as polybutadiene polyol and polyisoprene polyol or hydrogenated products thereof, and polycarbonate polyol.

Optionally, these polyol components may be prepared as prepolymers having chains preliminarily extended by an isocyanate such as 2,4-tolylene diisocyanate (TDI), 1,4-diphenylmethane diisocyanate (MDI), and isophorone diisocyanate (IPDI).

The polyether polyol and the polyester polyol have number average molecular weights of particularly preferably 1000 or more and 4000 or less. The polyol having a number average molecular weight of 1000 or more and 4000 or less has high reactivity with the isocyanate because the amount of the hydroxyl group is high relative to the molecular weight. As a result, the non-reacted component is reduced to attain high charging properties under a high temperature and high humidity environment.

The isocyanate compound to be reacted with these polyol components and the compound represented by Formula (1) are not limited in particular, and the followings can be used: aliphatic polyisocyanates such as ethylene diisocyanate, and 1,6-hexamethylene diisocyanate (HDI); alicyclic polyisocyanates such as isophorone diisocyanate (IPDI), cyclohexane 1,3-diisocyanate, and cyclohexane 1,4-diisocyanate; aromatic isocyanates such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; copolymerized products and isocyanurate products thereof, TMP adducts, biuret products, and block products thereof.

Among these, aromatic isocyanates such as tolylene diisocyanate, diphenylmethane diisocyanate, and polymeric diphenylmethane diisocyanate are suitably used.

For the mixing ratio of the isocyanate compound to be reacted with the polyol component and the compound represented by Formula (1), the ratio of an isocyanate group can be in the range of 1.0 to 2.0 based on a hydroxyl group (1.0) in the polyol component or based on a hydroxyl group (1.0) in the compound represented by Formula (1).

As described above, the surface layer of the developing carrying member according to the present invention contains the urethane resin having a partial structure derived from a reaction of a polyisocyanate with the compound represented by Formula (1). Accordingly, the surface layer can give high charging properties to the toner.

Namely, in the urethane resin according to the present invention, the partial structure derived from a reaction of a polyisocyanate with the compound represented by Formula (1) contains a nitrogen atom having an unshared electron pair (lone pair). For this reason, the surface layer according to the present invention has an ability to give high negative charge to the toner having negative charging properties.

Generally, in low molecular weight and polyfunctional compounds, steric hindrance causes difficulties in reaction of all of the functional groups. The compound represented by Formula (1), however, has high reactivity of a terminal hydroxyl group or a terminal amino group due to the amino skeleton in the molecule. For this reason, portions not reacted with the polyisocyanate barely generate. As a result, it is thought that hard segments of the urethane resin have denser crosslinking structures to more significantly enhance the hardness of the hard segments. Probably for this reason, it is thought that the surface layer according to the present invention can prevent the toner layer thickness controlling member from being excessively pressed into the contact region between the developing carrying member and the toner layer thickness controlling member, thereby maintaining high rolling properties of the toner.

The present inventors have examined and found that the effect can be attained by a compound represented by Formula (1) having 4 or more and 7 or less hydroxyl groups or amino groups. For this reason, the compound represented by Formula (1) may have at least 4 terminal functional groups. Such a compound represented by Formula (1) can attain the same effect even if the rest of functional groups are substituted by an alkyl group. Accordingly, the urethane resin may have a partial structure derived from a reaction of a polyisocyanate with a compound represented by Formula (4), for example:

Formula (4)

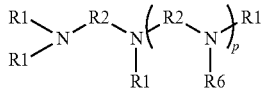

wherein R1 and R2 are the same as R1 and R2 in Formula (1); R6 can be a lower alkyl group having 1 or more and 3 or less carbon atoms which barely causes steric hindrance to the reaction of R1 with an isocyanate group; p represents 0 or an integer of 1 or more and 3 or less.

In the compound represented by Formula (1), R1 is each independently any one selected from the group consisting of (a) to (c): (a) a hydroxyalkyl group having 1 or more and 8 or less carbon atoms, (b) an aminoalkyl group having 2 or more and 8 or less carbon atoms, and (c) a group represented by Formula (2).

A crosslinking structure can be readily formed by a urethane or urea group when R1 is a hydroxyalkyl group having 1 or more and 8 or less carbon atoms or when R1 is an aminoalkyl group having 2 or more and 8 or less carbon atoms.

Formula (2) represents a group having the so-called ether repeating unit having a hydroxyl group at the terminal. When R1 is a group represented by Formula (2), R3 can be an alkylene group having 2 or more and 5 or less carbon atoms and the number of ether repetitions m can be an integer of 2 or more and 3 or less for the same reason as above.

In Formula (1), R2 can be an alkylene group having 2 or more and 4 or less carbon atoms. An alkylene group having 2 or more and 4 or less carbon atoms enhances the charging properties of the developing carrying member. It is thought that this is probably because if R2 is an alkylene group having 2 or more and 4 or less carbon atoms, the molecule has an appropriate size to provide high dispersibility during a reaction with an isocyanate.

Among the compounds represented by Formula (1), a compound represented by Formula (3), namely, a compound represented by Formula (1) wherein n is 1 or 2, R1 is each independently an alkylene group having 2 or 3 carbon atoms, and R3 is an alkylene group having 2 carbon atoms is particularly preferred.

The urethane resin having a partial structure derived from Formula (3) is particularly preferred because such a urethane resin has a functionality of 5 (pentafunctional) and the distance between urethane groups in the most suitable range to attain high rolling properties of the toner in the control portion.

Formula (3)

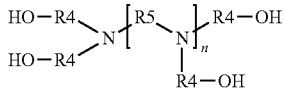

wherein n is 1 or 2, R4 each independently represents an alkylene group having 2 or 3 carbon atoms, and R5 represents an alkylene group having 2 carbon atoms.

In the present invention, the structure formed through a reaction of a polyisocyanate with the compound represented by Formula (1) has a urethane group at the terminal in Formula (1) when R1 is (a) a hydroxyalkyl group having 1 or more and 8 or less carbon atoms or (c) a group represented by Formula (2).

The partial structure formed through a reaction of a polyisocyanate with the compound represented by Formula (1) has a urea group at the terminal in Formula (1) when R1 is (b) an aminoalkyl group having 2 or more and 8 or less carbon atoms.

The surface layer 4 can have conductivity. Examples of a method of giving conductivity include addition of ionic conductive agents and conductive fine particles. In the present invention, conductive fine particles having the electric resistance which barely fluctuates due to environments are suitably used. Such conductive fine particles can be carbon black in particular because carbon black has high conductivity giving properties and can reinforce the surface layer. Carbon black having a primary particle diameter of 18 nm or more and 50 nm or less and a DBP oil absorption of 50 ml/100 g or more and 160 ml/100 g or less as properties is preferred because its conductivity, hardness, and dispersibility are well balanced. The content of the conductive fine particles can be 10% by mass or more and 30% by mass or less based on 100 parts by mass of the resin component that forms the surface layer.

When the developing carrying member needs surface roughness, a fine particle may be added to the surface layer 4 to control the surface roughness. The fine particle for controlling surface roughness can have a volume average particle diameter of 3 to 20 μm. The amount of the fine particle to be added to the surface layer can be 1 to 50 parts by mass based on 100 parts by mass of the resin solid content in the surface layer. Examples of the fine particle for controlling surface roughness include fine particles of polyurethane resins, polyester resins, polyether resins, polyamide resins, acrylic resins, and phenol resins.

Examples of a method of forming the surface layer include, but should not be limited to, spraying, immersion, or roll coating of coating materials. The immersion coating method of overflowing a coating material from the top of an immersion tank described in Japanese Patent Application Laid-Open No. S57-5047 is simple and has high production stability as a method of forming a surface layer.

<Toner>

The toner according to the present invention contains toner particles containing a binder resin and a colorant, and silica fine particles wherein the covering rate X1 of the surface of each of the toner particles with the silica fine particles determined with an X-ray electron spectroscope for chemical analysis (ESCA) is 40.0 area % or more and 75.0 area % or less and the diffusion index represented by Expression 1 satisfies Expression 2:

$$\text{diffusion index}=X1/X2 \quad \text{(Expression 1)}$$

$$\text{diffusion index}\geq -0.0042\times X1+0.62 \quad \text{(Expression 2)}$$

where a theoretical covering rate with the silica fine particles is defined as X2.

The present inventors have examined and found that use of such a toner can suppress fogging irrespective of environments in use.

Here, the present inventors think that fogging is caused for the following reason.

When a developing carrying member having high charging properties to the toner is used, the charge amount of the toner stagnating in the control portion under a low temperature and low humidity environment becomes abnormally high so that the toner adheres to the surface of the developing carrying member. When such a phenomenon occurs, a toner fed immediately after the formation of a black solid image passes through the blade nip with being barely charged by friction with the surface of the developing carrying member. As a result, the charge of the toner is readily reduced, a large amount of the reverse toner generates, and fogging significantly occurs.

To suppress fogging under the condition above, the present inventors think that the following points are important: (1) firm application of an external additive to the toner particles, and (2) charging of each toner particle in the blade nip. To realize (2) in particular, the following three points are important.

(2-1) Releasing Properties of Toner

This indicates releasability of the toner from the developing carrying member.

(2-2) Circulating Properties of Toner

This indicates movability of the toner not contacting the developing carrying member or the developing blade in cooperation with movement of the toner contacting the developing carrying member or the developing blade.

(2-3) Disaggregation of Toner

This indicates disaggregation of the toner such that particles of the toner are subjected to friction in the blade nip one by one.

The present inventors have found that if these are solved at the same time, the problems can be suppressed under conditions where suppression of fogging is difficult. In particular, the present inventors have found a close correlation between the "diffusion index" described later and the "phenomenon such that the particles of the toner disaggregate one by one", and have achieved the present invention.

Embodiments according to the present invention will now be described in detail. In the toner according to the present invention, the "state of silica fine particles externally added" is specified as follows.

In the toner according to the present invention, the covering rate X1 of the surface of each of the toner particles with silica fine particles determined with an X-ray electron spectroscope for chemical analysis (ESCA) is 40.0 area % or more and 75.0 area % or less, and the diffusion index represented by (Expression 1) satisfies (Expression 2)

$$\text{diffusion index}=X1/X2 \quad \text{(Expression 1)}$$

$$\text{diffusion index}\geq -0.0042\times X1+0.62 \quad \text{(Expression 2)}$$

where the theoretical covering rate with silica fine particles is defined as X2.

The covering rate X1 can be calculated from the ratio of the intensity of the Si element detected in measurement of the toner to the intensity of the Si element detected in measurement of only silica fine particles with the ESCA. The covering rate X1 indicates a proportion of the area of the surface of the toner particle actually coated with the silica fine particles to the area of the surface of the toner particle.

At a covering rate X1 of 40.0 area % or more and 75.0 area % or less, the fluidity and charging properties of the toner can be controlled in good states throughout the durability test. At a covering rate X1 of less than 40.0 area %, disaggregation of the toner described later cannot be sufficiently attained, so that fogging cannot be improved under severe evaluation conditions.

The theoretical covering rate with silica fine particles X2 can be calculated using parts by mass of the silica fine particles based on 100 parts by mass of the toner particles and the diameters of the silica fine particles from (Expression 4). X2 indicates a proportion of an area that can be theoretically coated with the surfaces of the toner particles.

$$\text{theoretical covering rate } X2(\text{area }\%)=31/2/(2\pi)\times(dt/da)\times(\rho t/\rho a)\times C\times 100 \quad \text{(Expression 4)}$$

da: number average particle diameter of silica fine particle (D1)

dt: weight average particle diameter of toner (D4)

ρa: true specific gravity of the silica fine particle

ρt: true specific gravity of the toner

C: mass of the silica fine particles/mass of the toner (for C, the content of the silica fine particles in the toner described later is used)

The physical meaning of the diffusion index represented by (Expression 1) will now be described.

The diffusion index indicates a divergence of the actually measured covering rate X1 from the theoretical covering rate X2. It is thought that the degree of divergence indicates the abundance of the silica fine particles vertically layered doubly or triply on the surfaces of the toner particles. Ideally the diffusion index is 1. In this case, the covering rate X1 corresponds to the theoretical covering rate X2, and the silica fine particles layered doubly or more does not exist at all. If the silica fine particles aggregate and exist on the surfaces of the toner particles as secondary particles, a divergence will generate between the actually measured covering rate and the theoretical covering rate to reduce the diffusion index. In other words, the diffusion index indicates the amount of the silica fine particles existing as secondary particles.

In the present invention, it is important that the diffusion index is in the range specified by Expression 2. The present inventors think that the range is wider than that of the toner produced by the conventional techniques. A higher diffusion index indicates that among the silica fine particles on the surfaces of the toner particles, the amount of the silica fine particles existing as secondary particles is smaller and the amount of the silica fine particles existing as primary particles is larger. As described above, the upper limit of the diffusion index is 1.

The present inventors have found that when the covering rate X1 and the diffusion index satisfy the range specified by Expression 2 at the same time, disaggregation of the toner during application of pressure can be significantly enhanced.

It has been thought that disaggregation of the toner can be enhanced by externally adding a large amount of an external additive having a small particle diameter of about several nanometers to increase the covering rate X1. In contrast, the present inventors have examined and clarified that the degree of disaggregation of the toner varies when the measurement is performed at the same covering rate X1 while the diffusion index is varied. The present inventors have clarified that the difference in the degree of disaggregation of the toner is more remarkable when the degree of disaggregation of the toner is measured while pressure is being applied. The present inventors think that particularly the behavior of the toner in the blade nip is reflected more significantly in the disaggregation of the toner during application of pressure. For this reason, the present inventors think that to more finely control the disaggregation of the toner during application of pressure, the diffusion index is very important in addition to the covering rate X1.

The present inventors presume the following reason why the disaggregation of the toner is enhanced when the covering rate X1 and the diffusion index satisfy the range specified by Expression 2 at the same time. When the toner exists in a narrow place with high pressure such as in a blade nip, particles of the toner are "meshed" with each other so as to prevent collision of the external additive existing on the surfaces thereof. Probably, such a behavior of particles of the toner enhances the disaggregation of the toner. At this time, if a larger amount of the silica fine particles exists as secondary particles, influences by the meshing are excessively great, leading to difficulties in the disaggregation of the toner particles.

In the present invention, the boundary of the diffusion index is a function wherein the covering rate X1 is a variable in the range of the covering rate X1 of 40.0 area % or more and 75.0 area % or less. When the covering rate X1 and the diffusion index are determined by varying the silica fine particles and conditions on external addition, the function is empirically obtained from the phenomenon that the toner sufficiently disaggregates during application of pressure.

Here, the present inventors presume the following reason why the diffusion index depends on the covering rate X1. To enhance the disaggregation of the toner during application of pressure, the amount of the silica fine particles existing as secondary particles may be small. The covering rate X1, however, has no small effect on the disaggregation of the toner. As the covering rate X1 increases, the disaggregation of the toner is gradually increased, and as a result the allowance of the amount of the silica fine particles existing as secondary particles is also increased. Thus, the present inventors think that the boundary of the diffusion index is a function wherein the covering rate X1 is a variable. Namely, the present inventors have empirically determined that the covering rate X1 and the diffusion index have a correlation and it is important to control the diffusion index according to the covering rate X1.

When the diffusion index is in the range specified by (Expression 3), the amount of the silica fine particles existing as secondary particles is large, leading to insufficient disaggregation of the toner. As a result, fluidity is reduced and fogging is increased.

$$\text{diffusion index} < -0.0042 \times X1 + 0.62 \qquad \text{(Expression 3)}$$

The toner according to the present invention contains toner particles containing a binder resin and a colorant, and silica fine particles. In the present invention, the toner contains preferably 0.40 parts by mass or more and 1.50 parts by mass or less of the silica fine particles based on 100 parts by mass of the toner particles. The toner contains more preferably 0.50 parts by mass or more and 1.30 parts by mass or less of the silica fine particles based on 100 parts by mass of the toner particles.

If the content of the silica fine particles is controlled to fall within the range above, the fluidity of the toner can be controlled in a proper state to provide images with higher quality.

The silica fine particles are treated with 15.0 parts by mass or more and 40.0 parts by mass or less of silicone oil based on 100 parts by mass of a silica raw material. The fixation rate (%) with the silicone oil can be 70% or more in terms of the amount of carbon.

The fixation rate (%) with the silicone oil in terms of the amount of carbon corresponds to the amount of the silicone oil molecules chemically bonded to the surface of the silica raw material.

If the amount (parts) of the silica fine particles treated with the silicone oil and the fixation rate of the silica fine particles are controlled to fall within the ranges above, the aggregation properties between the silica fine particles and the friction coefficient can be controlled within preferred ranges in the present invention. The same properties can be given to the toner to which the silica fine particles are externally added, and the effect (2) above is readily improved. The present inventors presume that the effect is demonstrated according to the following mechanism.

Generally, it is known that if the amount (parts) of the silicone oil to be added to the silica raw material is increased, the low surface energy of the silicone oil molecule improves the releasing properties of the toner from the developing carrying member or the developing blade. The affinity of the silicone oil molecules reduces the releasing properties or the aggregation properties of the silica fine particles and increases the friction coefficient of the silica fine particles. As one feature of the present invention, silica fine particles treated with a relatively large amount of the silicone oil and having a high fixation rate are used. Such silica fine particles can increase the friction coefficient without reducing the aggregation properties of the silica fine particles. The present inventors think that a reduction in aggregation properties can be suppressed by fixing the terminals of the silicone oil molecules to the surface of the silica raw material.

Next, influences of the silica fine particles on the surfaces of the toner particles in external addition to the toner particles will be described. When a covering rate X1 of the surface of each of the toner particles with the silica fine particles is in the range described above and particles of the toner contact each other, microscopically the contact between the silica fine particles existing on the surfaces of the toner particles is dominant, and the toner is also strongly influenced by the properties of the silica fine particles. Accordingly, it can be said that the toner according to the present invention has an increased friction coefficient of particles of the toner without reducing the aggregation properties of the toner and improved releasing properties from the developing carrying member or the developing blade.

If the friction coefficient is increased without reducing the aggregation properties of the toner, the toner not contacting the developing blade or the developing carrying member can move due to a sufficient frictional force generated between particles of the toner when the toner contacting the developing blade or the developing carrying member move. As a result, the toner can be significantly circulated in the blade nip. Namely, the effects (2-1) and (2-2) can be attained at the same time.

The amount of the silicone oil used to treat the silica fine particles can be 17.0 parts by mass or more and 30.0 parts by mass or less based on 100 parts by mass of the silica raw material, and the fixation rate (%) by the silicone oil in terms of the amount of carbon is preferably 90% or more.

The toner according to the present invention contains a colorant.

Examples of the colorant that can be used in the present invention include the followings.

Examples of cyan colorants include organic pigments or organic dyes such as copper phthalocyanine compounds and derivatives thereof, anthraquinone compounds, and basic dye lake compounds.

Examples of magenta colorants include the following organic pigments or organic dyes such as condensation azo compounds, diketopyrrole compounds, anthraquinones, quinacridone compounds, basic dye lake compounds, naphthol compounds, benzimidazolone compounds, thioindigo compounds, and perylene compounds.

Examples of yellow colorants include organic pigments or organic dyes of the following compounds such as condensation azo compounds, isoindolinone compounds, anthraquinone compounds, azo metal complexes, methine compounds, and allylamide compounds.

Examples of black colorants include carbon black, and black products using the yellow colorants, the magenta colorants, and the cyan colorants.

When a colorant is used, 1 part by mass or more and 20 parts by mass or less of the colorant can be added to 100 parts by mass of a polymerizable monomer or a binder resin.

The toner according to the present invention can contain a magnetic substance. In the present invention, the magnetic substance can serve as a colorant.

The magnetic substance used in the present invention is composed of triiron tetraoxide or γ-iron oxide as a main component, and may contain elements such as phosphorus, cobalt, nickel, copper, magnesium, manganese, and aluminum. Examples of the shape of the magnetic substance include polyhedrons, octahedrons, hexahedrons, spherical shapes, needle-like shapes, and flakes. Magnetic substances in polyhedral, octahedral, hexahedral, and spherical shapes, which have small anisotropy, can be used to increase image density. In the present invention, the content of the magnetic substance can be 50 parts by mass or more and 150 parts by mass or less based on 100 parts by mass of a polymerizable monomer or a binder resin.

The toner according to the present invention can contain a wax. The wax to be contained can be a hydrocarbon wax. Examples of the wax also include amide wax, higher fatty acid, long-chain alcohol, ketone wax, ester wax, and derivatives thereof such as graft compounds and block compounds thereof. Optionally two or more of these waxes may be used in combination. Among these, when a hydrocarbon wax prepared by a Fischer-Tropsch method is used, high developability can be maintained for a long time and high off-set resistance at high temperature can be maintained. These hydrocarbon waxes may contain an antioxidant in the range so as not to impair the charging properties of the toner.

The content of the wax is preferably 4.0 parts by mass or more and 30.0 parts by mass or less, more preferably 16.0 parts by mass or more and 28.0 parts by mass or less based on 100 parts by mass of the binder resin.

The toner according to the present invention can contain a charge-controlling agent in the toner particles optionally. The charge-controlling agent can be compounded to stabilize charging properties and control so as to optimize the frictional charge amount according to the developing system.

Known charge-controlling agents can be used. In particular, charge-controlling agents that allow high speed charging and can maintain a predetermined charge amount stably can be used. When the toner particles are prepared by direct polymerization, charge-controlling agents that barely inhibit polymerization and contain substantially no soluble substance in an aqueous medium are particularly preferred.

The toner according to the present invention can contain these charge-controlling agents singly or in combinations of two or more.

The amount of the charge-controlling agent to be compounded is preferably 0.3 parts by mass or more and 10.0 parts by mass or less, more preferably 0.5 parts by mass or more and 8.0 parts by mass or less based on 100 parts by mass of a polymerizable monomer or a binder resin.

The toner according to the present invention contains toner particles and silica fine particles.

The silica fine particles used in the present invention can be prepared by hydrophobizing 100 parts by mass of the silica raw material with 15.0 parts by mass or more and 40.0 parts by mass or less of silicone oil. The degree of hydrophobization determined by a methanol titration test is preferably 70% or more, more preferably 80% or more from the viewpoint of suppression of a reduction in charging properties under a high temperature and high humidity environment.

Examples of the silicone oil include dimethyl silicone oil, methylphenyl silicone oil, α-methylstyrene modified silicone oil, chlorophenyl silicone oil, and fluorine modified silicone oil.

In the present invention, the kinematic viscosity at 25° C. of the silicone oil used in the treatment of the silica fine particles can be 30 cSt or more and 500 cSt or less. At a kinematic viscosity in the range above, the uniformity of the silica raw material can be readily controlled during hydrophobization of the silica raw material with the silicone oil. Furthermore, the kinematic viscosity of the silicone oil has a close relationship with the length of the molecule chain of the silicone oil. At a kinematic viscosity in the range above, the degree of aggregation of the silica fine particles can be readily controlled within a suitable range. A more preferred range of the kinematic viscosity at 25° C. of the silicone oil is cSt or more and 300 cSt or less. Examples of an apparatus for measuring the kinematic viscosity of the silicone oil include a capillary kinematic viscometer (available from Kaburagi Kagaku Kikai Kogyo K.K.) or an automatic micro kinematic viscometer (available from VISCOTECH CO., LTD.).

The silica fine particles used in the present invention can be prepared by treating the silica raw material with silicone oil, and then treating the silica raw material with at least one of alkoxysilane and silazane. Thereby, the surface of the silica raw material which cannot be hydrophobized with silicone oil can be hydrophobized to stably attain silica fine particles highly hydrophobized. Furthermore, the disaggregation of the toner can be significantly enhanced.

The present inventors think the following reason why the disaggregation of the toner can be enhanced. Among terminals of the silicone oil molecules on the surfaces of the silica fine particles, only one terminal has freedom and affects the aggregation properties of the silica fine particles. By the 2-stage treatment described above, the terminals of the silicone oil molecules are hard to exist on the outermost surfaces of the silica fine particles, and therefore the aggregation of the silica fine particles can be suppressed more significantly. That is, by employing the 2-stage treatment, the aggregation of the toner particles can be significantly reduced at the time when the silica fine particles are externally added, and disaggregation of the toner is enhanced.

In the present invention, the silica raw material that can be used are both of dry silica so-called dry or fumed silica prepared by vapor-phase oxidation of silicon halide and the so-called wet silica prepared from liquid glass, for example.

The silica fine particles used in the present invention may be crushed during or after the treatment step. When the 2-stage treatment is performed, crushing can be performed between the two treatment steps.

The surface treatment of the silica raw material with silicone oil and the surface treatment thereof with alkoxysilane and silazane may be a dry method or a wet method.

A procedure of the surface treatment of the silica raw material with silicone oil will be specifically described. For example, silica fine particles are added to a solvent having silicone oil dissolved therein (preferably adjusted with an organic acid to pH of 4) to make reaction, and subsequently, the solvent is removed. Subsequently, the crushing may be performed.

Then, a procedure of the surface treatment with at least one of alkoxysilane and silazane will be specifically described. The crushed silica fine particles treated with silicone oil are added to a solvent having at least one of alkoxysilane and silazane dissolved therein to make reaction. Subsequently, the solvent is removed, and the product is crushed. Alternatively, the following method may be used. For example, in the surface treatment with silicone oil, the silica fine particles are placed in a reaction tank. Under a nitrogen atmosphere, an alcohol is added while being stirred. Silicone oil is introduced into the reaction tank to perform surface treatment. The solvent is removed by stirring under heating, and the product is crushed. In the surface treatment with at least one of alkoxysilane and silazane, at least one of alkoxysilane and silazane is introduced under a nitrogen atmosphere while being stirred, and is subjected to surface treatment. The solvent is removed by stirring under heating. Then, the product is cooled.

Suitable examples of the alkoxysilane include methyltrimethoxysilane, dimethyldimethoxysilane, phenyltrimethoxysilane, methyltriethoxysilane, dimethyldiethoxysilane, and phenyltriethoxysilane. Suitable examples of the silazane include hexamethyldisilazane.

The total amount of at least one of alkoxysilane and silazane used in the surface treatment is 0.1 parts by mass or more and 20.0 parts by mass or less based on 100 parts by mass of the silica raw material.

To increase the fixation rate of the silica fine particles with silicone oil in terms of the amount of carbon, silicone oil needs to be chemically fixed onto the surface of the silica raw material during preparation of the silica fine particles. Suitable examples of a method of chemically fixing silicone oil onto the surface of the silica raw material include a method of performing heating to react silicone oil during preparation of silica fine particles. The heating temperature can be 100° C. or more. A higher heating temperature can attain a higher fixation rate. The heating step can be performed immediately after the surface treatment with silicone oil is performed. When the crushing is performed, the heating step may be performed after the crushing step.

The silica fine particles used in the present invention can have an apparent density of 15 g/L or more and 50 g/L or less. An apparent density of the silica fine particles in the range above indicates that the silica fine particles are present not so densely, contain a large amount of air between fine particles, and have an extremely low apparent density. For this properties, particles of the toner can be prevented from being so dense, significantly reducing the speed of a reduction in degradation of the toner. A more preferred range is 18 g/L or more and 45 g/L or less.

Examples of a method of controlling the apparent density of the silica fine particles to fall within the range above include adjustment of the particle diameter of the silica raw material used for the silica fine particles, the crushing step to be performed or not and the strength of the crushing, and the amount of silicone oil used in the surface treatment. A reduction in the particle diameter of the silica raw material can increase the BET specific surface area of the silica fine particles to be prepared. As a result, the silica fine particles can contain a large amount of air therebetween to reduce the apparent density. The crushing step can be performed to disaggregate relatively large secondary particles contained in the silica fine particles into relatively small secondary particles to reduce the apparent density.

To give high fluidity to the toner, the silica raw material used in the present invention can have a specific surface area (BET specific surface area) of 130 $m^2/g$ or more and 330 $m^2/g$ or less, which is measured by nitrogen adsorption according to a BET method. A specific surface area in this range can readily ensure the fluidity and the charging properties to be given to the toner. The BET specific surface area of the silica raw material is more preferably 200 $m^2/g$ or more and 320 $m^2/g$ or less.

The specific surface area (BET specific surface area) is measured by nitrogen adsorption in the BET method according to JIS Z 8830 (2001). For the measurement apparatus, an "automatic specific surface area and pore distribution measurement apparatus TriStar 3000 (available from SHIMADZU Corporation)" is used. The TriStar 3000 employs a gas adsorption method according to a constant volume method as a measurement method.

The primary particles of the silica raw material used in the present invention have a number average particle diameter of preferably 3 nm or more and 50 nm or less, more preferably 5 nm or more and 40 nm or less.

The toner according to the present invention has a weight average particle diameter (D4) of preferably 5.0 μm or more and 10.0 μm or less, more preferably 5.5 μm or more and 9.5 μm or less from the viewpoint of the balance between developability and fixing properties.

In the present invention, the toner particles have an average circularity of preferably 0.960 or more, more preferably 0.970 or more. If the toner particles have an average circularity of 0.960 or more, the toner has a spherical shape or a substantially spherical shape, and readily attains high fluidity and uniform friction charging properties. For this reason, preferably the toner can readily maintain high developability even in the latter half of the durability test. In addition, preferably toner particles having a high average circularity can be readily controlled to have a covering rate X1 and the diffusion index within the ranges specified in the present invention during external addition of inorganic fine particles described later. Furthermore, such toner particles having a high average circularity are preferred from the viewpoint of disaggregation of the toner during application of pressure because the meshing of the toner particles due to the shapes of the surfaces thereof barely occurs and the disaggregation of the toner can be enhanced more significantly.

Examples of a method of preparing the toner according to the present invention will be described below, but the method will not be limited to these.

The toner according to the present invention can be prepared by any known method without limitation if the amount (parts) of the silica fine particles treated with silicone oil, the fixation rate of silicone oil in terms of the amount of carbon, the covering rate X1, and the diffusion index can be adjusted, and a step of adjusting the average circularity can be included.

In preparation of the toner by a grinding method, for example, a binder resin, a colorant, and optionally other additives such as a mold release agent are sufficiently mixed with a mixer such as a Henschel mixer or a ball mill. Subsequently, the toner materials are melt kneaded with a heat kneader such as a heat roll, a kneader, and an extruder to disperse or dissolve the toner materials. The kneaded product is solidified by cooling, is ground, is classified, and is optionally surface treated to prepare toner particles. The classification may be performed before or after the surface treatment. In the classification step, a multi classifier can be used for production efficiency.

The grinding can be performed by a method with a known grinder of a mechanical impact type or a jet type. To attain a toner having a preferred circularity specified in the present invention, additional treatment to grind the kneaded product under heating or apply a mechanical impact supplementally can be performed. Alternatively, a hot water bath method of dispersing pulverized (optionally classified) toner particles in hot water or a method of passing toner particles through hot air stream may be used.

Examples of a method of applying a mechanical impact include methods with a mechanical impact mill such as a CRYPTRON system available from Kawasaki Heavy Industries, Ltd. and a turbo mill available from FREUND-TURBO CORPORATION. Examples thereof also include methods of applying a mechanical impact such as a compressive force and a frictional force to a toner with an apparatus such as a Mechanofusion system available form Hosokawa Micron Corporation and a hybridization system available from Nara Machinery Co., Ltd.

The toner particles used in the present invention are prepared in an aqueous medium preferably by a method such as dispersion polymerization, association aggregation, dissolution suspension, and suspension polymerization, and more preferably by suspension polymerization.

In the suspension polymerization, a polymerizable monomer, a colorant, and optionally other additives such as a polymerization initiator, a crosslinking agent, and a charge-controlling agent are uniformly dissolved or dispersed to prepare a polymerizable monomer composition. Subsequently, the polymerizable monomer composition is dispersed in a continuous phase (such as an aqueous phase) containing a dispersion stabilizer with a proper stirrer, and is the polymerizable monomer in the polymerizable monomer composition is polymerized to prepare toner particles having a desired particle diameter. The toner particles prepared by the suspension polymerization (hereinafter also referred to as "polymerization toner particles") can have a substantially spherical shape. Such toner particles can have a predetermined average circularity and relatively uniform distribution of the charge amount.

In preparation of the polymerized toner particles according to the present invention, any known polymerizable monomer for the polymerizable monomer composition can be used. Among these, styrene or a styrene derivative can be used alone or by mixing with another polymerizable monomer from the viewpoint of the developing properties and the durability of the toner.

In the present invention, the polymerization initiator used in the suspension polymerization can have a half-life period during the polymerization reaction of 0.5 hours or more and 30.0 hours or less. The amount of the polymerization initiator to be added can be 0.5 parts by mass or more and 20.0 parts by mass or less based on 100 parts by mass of the polymerizable monomer.

Specific examples of the polymerization initiator include azo or diazo polymerization initiators and peroxide polymerization initiators.

In the suspension polymerization, a crosslinking agent may be added during the polymerization reaction. A preferred the amount of the crosslinking agent to be added is 0.1 parts by mass or more and 10.0 parts by mass or less based on 100 parts by mass of a polymerizable monomer.

Here, mainly a polymerizable compound having two or more double bonds is used as a crosslinking agent. For example, aromatic divinyl compounds, carboxylic acid esters having two double bonds, divinyl compounds, and compounds having 3 or more vinyl groups can be used singly or as a mixture of two or more.

Specific preparation of toner particles by the suspension polymerization will now be described, but the preparation will not be limited to this. First, the polymerizable monomer, the colorant, and the like are properly added, and are uniformly dissolved or dispersed with a dispersing machine such as a homogenizer, a ball mill, and an ultrasonic dispersing machine to prepare a polymerizable monomer composition. The polymerizable monomer composition is suspended in an aqueous medium containing a dispersion stabilizer. At this time, the polymerizable monomer composition is formed into toner particles having a desired particle diameter with a dispersing machine such as a high-speed stirrer or an ultrasonic dispersing machine at once. Thereby, the toner particles to be prepared have shaper distribution of the particle diameter. The polymerization initiator may be added simultaneously when other additives are added to the polymerizable monomer or immediately before the polymerizable monomer composition is suspended in an aqueous medium. Alternatively, a polymerization initiator dissolved in the polymerizable monomer or a solvent may be added immediately after granulation and before the polymerization reaction is initiated.

After the granulation, the particles may be stirred with a standard stirrer to such an extent that the states of the particles are maintained and floating and sediment thereof are prevented.

Any known surfactant, organic dispersant, or inorganic dispersant can be used as the dispersion stabilizer. Among these, inorganic dispersants can be used for the following reasons: these barely generate harmful ultra fine powder; dispersion stability is attributed to their steric hindrance and is barely affected even if the reaction temperature is varied; and inorganic dispersants are readily washed off and barely affect the toner. Examples of such inorganic dispersants include phosphoric acid polyvalent metal salts such as tricalcium phosphate, magnesium phosphate, aluminum phosphate, zinc phosphate, and hydroxy apatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

Preferably, 0.20 parts by mass or more and 20.00 parts by mass or less of the inorganic dispersant is used based on 100 parts by mass of the polymerizable monomer. These dispersion stabilizers may be used singly or in combinations of two or more. Furthermore, 0.0001 parts by mass or more and 0.1000 parts by mass or less of a surfactant may be used in combination based on 100 parts by mass of the polymerizable monomer.

In the polymerization reaction of the polymerizable monomer, the polymerization temperature is set at 40° C. or more, typically at 50° C. or more and 90° C. or less.

After the polymerization of the polymerizable monomer is completed, the resulting polymer particles are filtered, are washed, and are dried by known methods to prepare toner particles. The silica fine particles as inorganic fine particles are externally added to the toner particles by mixing and are adhered to the surfaces of the toner particles to prepare the toner according to the present invention.

Alternatively, a classification step can be provided in the preparation step (before the step of mixing the inorganic fine particles) to remove coarse particles and fine particles from the toner particles.

The toner according to the present invention may contain, in addition to the silica fine particles, particles containing primary particles having a number average particle diameter (D1) of 80 nm or more and 3 μm or less. For example, a lubricant such as fluorine resin powder, zinc stearate powder, or polyvinylidene fluoride powder; a polishing agent such as cerium oxide powder, silicon carbide powder, or strontium titanate powder; or spacer particles such as silica can be slightly used in the ranges so as not to impair the effect of the present invention.

Any known mixing apparatus can be used as a mixing apparatus for externally adding the silica fine particles by mixing. An apparatus illustrated in FIG. 5 can be used because the covering rate X1 and the diffusion index can be readily controlled.

Figure 5:
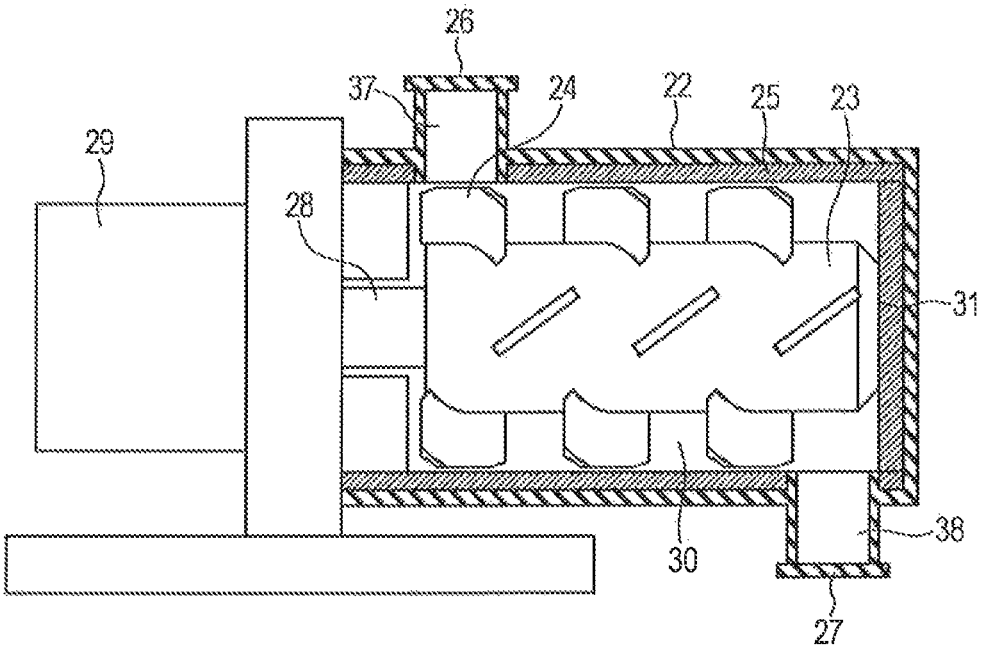
FIG. 5 is a schematic view illustrating an example of a mixing apparatus which can be used for external addition of inorganic fine particles by mixing.

FIG. 5 is a schematic view illustrating an example of a mixing apparatus that can be used in external addition of the silica fine particles used in the present invention by mixing.

The mixing apparatus is configured to apply a shear force to the toner particles and the silica fine particles in a narrow clearance, so that the silica fine particles can be applied to the surfaces of the toner particles while secondary particles thereof are being disaggregated into primary particles thereof.

Furthermore, as described later, the toner particles and the silica fine particles are readily circulated in the axial direction of a rotary member, and are sufficiently uniformly mixed before the particles solidify. For this reason, the covering rate X1 and the diffusion index are readily controlled to fall within preferred ranges specified in the present invention.

Figure 6:
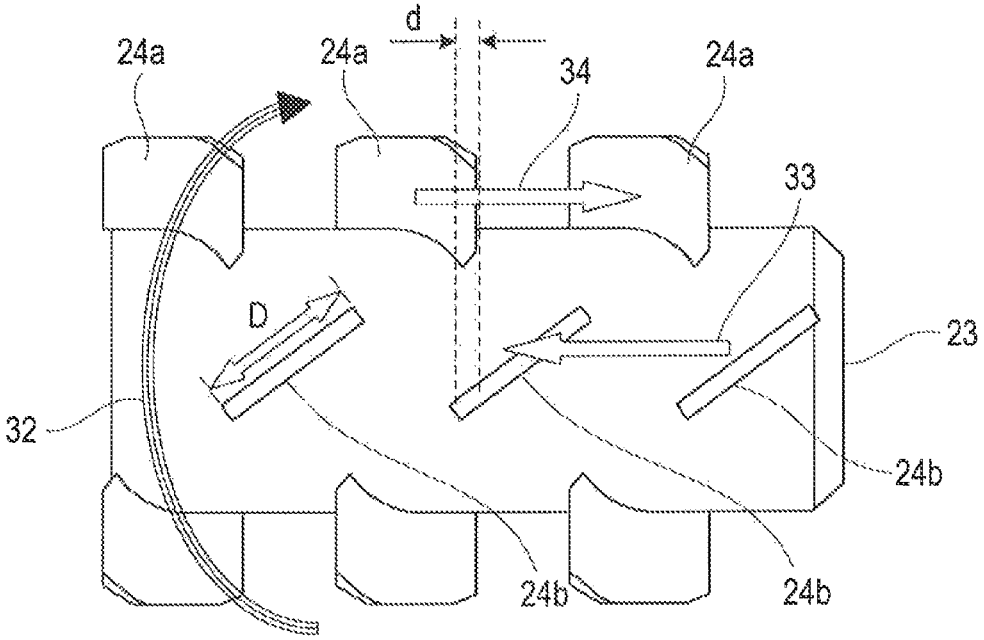
FIG. 6 is a schematic view illustrating an example of the constitution of a stirring member used for a mixing apparatus.

FIG. 6 is a schematic view illustrating an example of a configuration of a stirring member used in the mixing apparatus.

A step of externally adding the silica fine particles by mixing will now be described with reference to FIG. 5 and FIG. 6.

The mixing apparatus for externally adding the silica fine particles by mixing includes at least a rotary member 2 provided with a plurality of stirring members 24 on the surface thereof, a driving unit 29 rotatably driving the rotary member, and a main body casing 22 spaced from the stirring members 24.

It is important to constantly and finely maintain spaces (clearances) formed between the inner circumferential portion of the main body casing 22 and the stirring members 24 to uniformly give a shear force to the toner particles and apply the silica fine particles to the surfaces of the toner particles while secondary particles of the silica fine particles are being disaggregated into primary particles thereof.

In this apparatus, the diameter of the inner circumferential portion of the main body casing 22 is twice or less the diameter of the outer circumferential portion of the rotary member 23. In FIG. 5, an example is illustrated in which the diameter of the inner circumferential portion of the main body casing 22 is 1.7 times the diameter of the outer circumferential portion of the rotary member 23 (diameter of the body of the rotary member 23 excluding the stirring members 24). If the diameter of the inner circumferential portion of the main body casing 22 is twice or less the diameter of the outer circumferential portion of the rotary member 23, the space for treatment in which a force acts on the toner particles is properly limited. As a result, a sufficient impact is applied to the secondary particles of the silica fine particles.

It is important to adjust the clearances according to the size of the main body casing. For the viewpoint of application of a sufficient shear force to the silica fine particles, it is important that the clearances occupies about 1% or more and 5% or less of the diameter of the inner circumferential portion of the main body casing 22. Specifically, when the diameter of the inner circumferential portion of the main body casing 22 is about 130 mm, the clearances may have lengths of about 2 mm or more and 5 mm or less. When the diameter of the inner circumferential portion of the main body casing 22 is about 800 mm, the clearances may have lengths of about 10 mm or more and 30 mm or less.

In the step of externally adding the silica fine particles according to the present invention by mixing, a mixing apparatus is used to rotate the rotary member 23 by the driving unit 29, and the toner particles and the silica fine particles placed in the mixing apparatus are mixed by stirring to externally adding the silica fine particles to the surfaces of the toner particles by mixing.

As illustrated in FIG. 6, at least part of a plurality of stirring members 24 is formed as stirring members 24*a* for feeding. Accompanied by the rotation of the rotary member 23, the stirring members 24*a* feed the toner particles and the silica fine particles in one direction of the axial direction of the rotary member. At least part of a plurality of stirring members 24 is formed as stirring members 24*b* for reversing. Accompanied by the rotation of the rotary member 23, the toner particles and the silica fine particles are reversed in the other direction of the axial direction of the rotary member.

Here, as illustrated in FIG. 5, when a raw material inlet 5 and a product outlet 27 are provided in the respective ends of the main body casing 22, the direction from the raw material inlet 26 to the product outlet 27 (to the right in FIG. 5) is called the "feeding direction."

Namely, as illustrated in FIG. 6, the stirring members 24*a* for feeding have the surfaces inclined so as to feed the toner particles in the feeding direction (34). The stirring members 24*b* have the surfaces inclined so as to feed the toner particles and the silica fine particles in the reverse direction (33).

Such an apparatus repeatedly performs feeding in the "feeding direction" (34) and feeding in the "reverse direction" (33) to externally adding the silica fine particles to the surfaces of the toner particles by mixing.

The stirring members 24*a* and 24*b* form a set of a plurality of members disposed at intervals in the circumferential direction of the rotary member 23. In the example illustrated in FIG. 6, one stirring member 24*a* and one stirring member 24*b* disposed at an interval of 180° in the rotary member 23 form a set. Three stirring members disposed at intervals of 120°, or four stirring members disposed at intervals of 90° may form a set, for example.

In the example illustrated in FIG. 6, a total of twelve stirring members 24*a* and 24*b* are formed at equal intervals.

In FIG. 6, D represents the width of the stirring member, and d represents an interval indicating the overlapped portion of the stirring members. To efficiently feed the toner particles and the silica fine particles in the feeding direction and the reverse direction, the width D can be about 20% or more and 30% of the length of the rotary member 23 in FIG. 6. In the example illustrated in FIG. 6, the width D is 23% of the length of the rotary member 23. Furthermore, the stirring members 24*a* and 24*b* can have some overlapped portion d of the stirring members 24*b* and the stirring members when an extending line is drawn from the end of the stirring members 24*a* in the vertical direction. This overlapped portion can efficiently apply a shear force to the secondary particles of the silica fine particles. The proportion of d to D can be 10% or more and 30% or less from the viewpoint of application of a shear force.

The blade can have any shape other than the shape illustrated in FIG. 6 as long as the toner particles can be fed in the feeding direction and the reverse direction and the clearances can be maintained. For example, the blade may have a curved surface or a paddle structure connected to the rotary member 23 with a rod-like arm provided at one end of the blade.

With reference to the schematic views of the apparatus illustrated in FIG. 5 and FIG. 6, the present invention will now be described in more detail.

The apparatus illustrated in FIG. 5 includes at least a rotary member 23 provided with a plurality of stirring members 24 on the surface thereof, a driving unit rotatably driving the rotary member 23, a main body casing 22 spaced from the stirring members 24, and a jacket disposed inside the main body casing 22 on the end surface of the rotary member 31, a cooling and heating medium flowing through the jacket.

The apparatus illustrated in FIG. 5 further includes a raw material inlet 26 disposed on an upper portion of the main body casing 22 to introduce the toner particles and the silica fine particles, and a product outlet 27 disposed on a lower portion of the main body casing 22 to discharge the toner externally added by mixing from the main body casing 22 to the outside.

The apparatus illustrated in FIG. 5 further includes an inner piece 37 for the raw material inlet disposed inside the raw material inlet 26 and an inner piece 38 for the product outlet disposed inside the product outlet 37.

In the present invention, first, the inner piece 37 for the raw material inlet is extracted from the raw material inlet 26, and the toner particles are placed in a treatment space 30 from the raw material inlet 26. Next, the silica fine particles are placed in the treatment space 30 from the raw material inlet 26, and the inner piece 37 for the raw material inlet is inserted. Next, the rotary member 23 is rotated by the driving unit 29 (in the rotational direction 32), and the external addition by mixing are performed while the particles to be treated are being mixed by stirring with the stirring members 24 disposed on the surface of the rotary member 23.

These materials may be added in any order. The silica fine particles may be added from the raw material inlet 26, and then the toner particles may be added from the raw material inlet 26. Alternatively, the toner particles and the silica fine particles may be preliminarily mixed with a mixer such as a Henschel mixer, and the mixture may be added from the raw material inlet 26 of the apparatus illustrated in FIG. 5.

More specifically, for the conditions on the external addition by mixing, the power of the driving unit 29 can be controlled to be 0.2 W/g or more and 2.0 W/g or less to attain the covering rate X1 and the diffusion index specified in the present invention. The power of the driving unit 29 is controlled to be more preferably 0.6 W/g or more and 1.6 W/g or less.

At a power of less than 0.2 W/g, the covering rate X1 is difficult to increase and the diffusion index is excessively reduced. At a power of more than 2.0 W/g, the diffusion index is increased while the silica fine particles are excessively buried.

Any treatment time can be used without particular limitation. The treatment time can be 3 minutes or more and 10 minutes or less. At a treatment time less than 3 minutes, the covering rate X1 and the diffusion index are reduced.

The external addition by mixing can be performed at any number of rotations of the stirring members without particular limitation. The number of rotations of the stirring member can be 800 rpm or more and 3000 rpm or less where the volume of the treatment space 9 in the apparatus illustrated in FIG. 5 is $2.0\times10^{-3}$ $m^3$ and the stirring member 24 has the shape in FIG. 6. At number of rotations of 800 rpm or more and 3000 rpm or less, the covering rate X1 and the diffusion index specified in the present invention are readily attained.

In the present invention, a particularly preferred processing method includes a pre-mixing step before the operation of external adding by mixing. The pre-mixing step can more uniformly disperse the silica fine particles on the surfaces of the toner particles to readily increase the covering rate X1 and the diffusion index.

More specifically, a pre-mixing condition can be set at a power of the driving unit 29 of 0.06 W/g or more and 0.20 W/g or less and a treatment time of 0.5 minutes or more and 1.5 minutes or less. If the pre-mixing condition is not satisfied, for example, the load power is less than 0.06 W/g or the treatment time is less than 0.5 minutes, the raw materials particles are unlikely to be sufficiently uniformly mixed during pre-mixing. If the pre-mixing condition is not satisfied, for example, the load power is more than 0.20 W/g or the treatment time is more than 1.5 minutes, the silica fine particles may be fixed to the surfaces of the toner particles before these particles are sufficiently uniformly mixed.

In the pre-mixing, the number of rotations of the stirring members can be 50 rpm or more and 500 rpm or less when the stirring members 24 have the shapes illustrated in FIG. 6 in an apparatus illustrated in FIG. 5 having a treatment space 9 having a volume of $2.0\times10^{-3}$ $m^3$. If the number of rotations is 50 rpm or more and 500 rpm or less, the covering rate X1 and the diffusion index specified in the present invention are readily attained.

After the external addition by mixing is completed, the inner piece 38 for a product outlet in the product outlet 27 is extracted, and the rotary member 23 is rotated by the driving unit 29 to discharge a toner from the product outlet 27. The toner is optionally separated from coarse particles with a sieving machine such as a circular vibration sieving machine. The target toner is prepared.

<Method of Measuring Physical Properties>

[1] Measurement of Surface Roughness of Surface of Developing Carrying Member (Ra: Arithmetic Average Roughness)

In a developing carrying member, nine places in total (three places in the axial direction by three places in the circumferential direction) are measured with a surface roughness measuring apparatus (trade name: SURFCORDER SE-3500, available from Kosaka Laboratory Ltd.) according to surface roughness (JIS B 0601-2001). The average value is defined as the surface roughness Ra of the developing carrying member. The cut off is 0.8 mm, a distance for measurement is 8.0 mm, and the feeding rate is 0.2 mm/sec.

[2] Method of Quantifying Silica Fine Particles (1) Quantification of Content of Silica Fine Particles in Toner (Method of Standard Addition)

A toner (3 g) is placed in an aluminum ring having a diameter of 30 mm, and a pressure of 10 tons is applied to the toner to prepare a pellet. The intensity of silicon (Si) (Si Intensity-1) is determined by a wavelength dispersing fluorescence X-ray analysis (XRF). The conditions on the measurement may be optimized with an XRF apparatus to be used, and a series of measurement of intensity is performed on the same conditions. Silica fine particles (1.0% by mass relative to the toner) having primary particles having a number average particle diameter of 12 nm are added to the toner, and are mixed with a coffee mill.

After the mixing, the product is formed into a pellet, and the intensity of Si (Si Intensity-2) is determined in the same manner as above. The same operation is performed on samples having different contents of the silica fine particles (2.0% by mass and 3.0% by mass relative to the toner), and the intensities of Si (Si Intensity-3 and Si Intensity-4) are determined. From Si Intensity-1 to Si Intensity-4, the content of silica in the toner (% by mass) is calculated according to the method of standard addition.

(2) Separation of Silica Fine Particles from Toner

When a toner contains a magnetic substance, the silica fine particles are quantified through the following step.

A toner (5 g) is weighed with a precision balance, and is placed in a 200 ml plastic cup with a lid. Methanol (100 ml) is added, and the toner is dispersed with an ultrasonic dispersing machine for 5 minutes. The toner is attracted to a neodymium magnet, and the supernatant solution is discharged. This operation of dispersion in methanol and discharge of the supernatant is repeated three times. Then, 10% NaOH (100 ml) and several drops of "CONTAMINON N" (trade name, 10% by mass aqueous solution of a neutral detergent for washing a precision measurement apparatus (pH: 7) composed of a nonionic surfactant, an anionic surfactant, and an organic builder, available from Wako Pure Chemical Industries, Ltd.) are added, and are slightly mixed. The mixture is left as it is for 24 hours. Subsequently, particles are separated again with a neodymium magnet. At this time, the recovered particles are repeatedly washed with distilled water to wash off NaOH residues. The recovered particles are sufficiently dried in a vacuum dryer to prepare Particle A. Through the operation, the externally added silica fine particles are dissolved and removed.

(3) Measurement of Intensity of Si in Particle A

Particle A (3 g) is placed in an aluminum ring having a diameter of 30 mm, and a pressure of 10 tons is applied to the toner to prepare a pellet. The intensity of Si (Si Intensity-5) is determined by a wavelength dispersing fluorescence X-ray analysis (XRF). From Si Intensity-5 and Si Intensity-1 to Si Intensity-4 used in the quantification of the content of silica in the toner, the content of silica in Particle A (% by mass) is calculated.

(4) Separation of Magnetic Substance from Toner

Tetrahydrofuran (100 ml) is added to Particle A (5 g), and is mixed sufficiently. Particle A is ultrasonic dispersed for 10 minutes. Magnetic particles are attracted to a magnet, and the supernatant solution is discharged. This operation is repeated 5 times to prepare Particle B. Through this operation, besides the magnetic substance, almost all of organic components such as a resin can be removed. Some resin not dissolved in tetrahydrofuran may remain. Accordingly, Particle B prepared through the operation above can be heated to 800° C. to burn organic components, if remain. Particle C prepared after the heating can be considered approximately as the magnetic substance contained in the toner.

The mass of Particle C is measured. The mass can be defined as the content W of the magnetic substance in the magnetic toner (% by mass). At this time, to correct an amount increased by oxidation of the magnetic substance, the mass of Particle C is multiplied by 0.9666 ($Fe_2O_3$ - - - >$Fe_3O_4$). The values obtained from the quantifications above are substituted for variables in the following expression to calculate the amount of the externally added silica fine particles:

amount of the externally added silica fine particles (% by mass)=the content of silica in the toner (% by mass)−the content of silica in Particle *A*(% by mass)

[3] Method of Measuring Covering Rate X1

The covering rate X1 of the surface of the toner particle with the silica fine particles is calculated as follows.

The surfaces of the toner particles are subjected to element analysis with the following apparatus on the following conditions:

Measurement apparatus: Quantum 2000 (trade name, available from ULVAC-PHI, Inc.)

X-ray source: monochrome Al Kα

X-ray Setting: 100 μmϕ (25 W (15 KV))

Photoelectron take off angle: 45°

Neutralization condition: neutralization gun in combination with an ion gun

Analysis region: 300×200 μm

Pass Energy: 58.70 eV

Step size: 1.25 eV

Software for analysis: Maltipak (Physical Electronics, Inc.)

Here, the quantified value of an Si atom is calculated with peaks of C 1c (B.E. 280 to 295 eV), O 1s (B.E. 525 to 540 eV), and Si 2p (B.E. 95 to 113 eV). The quantified value of the Si element obtained here is defined as Y1.

Next, a single substance of silica fine particles is measured. For a method of obtaining a single substance of silica fine particles from a toner, the method described in "Separation of silica fine particles from toner" is used. The silica fine particles obtained as a single substance of silica fine particles are subjected to element analysis in the same manner as in the element analysis of the surface of the toner. The obtained quantified value of the Si element is defined as Y2.

In the present invention, the covering rate X1 of the surface of the toner particle with the silica fine particles is defined as follows: covering rate X1 (area %)=Y1/Y2×100

To enhance the precision of the measurement, Y1 and Y2 can be measured twice or more.

[4] Method of Measuring Weight Average Particle Diameter of Toner (D4)

The weight average particle diameter (D4) of the toner (and that of the toner particles) is calculated as follows. For the measurement apparatus, a precision particle size distribution analyzer "Coulter Counter Multisizer 3" (trade name, available from Beckman Coulter, Inc.) is used. The analyzer includes an aperture tube of 100 μm and employs a pore electrical resistance method. The conditions on measurement are set and the data measured is analyzed with the attached dedicated software "Beckman Coulter Multisizer 3 Version 3.51" (trade name, available from Beckman Coulter, Inc.). The measurement is performed with 25000 effective measuring channels.

The electrolytic aqueous solution that can be used in the measurement is a dissolution solution of about 1% by mass super grade sodium chloride in ion exchange water such as "ISOTON II" (trade name, available from Beckman Coulter, Inc.).

The dedicated software is set before the measurement and analysis are performed.

With the dedicated software, the total number of counts in the control mode is set at 50000 particles on the "Change standard measuring method (SOM)" screen. The number of measurement is set at 1, and the Kd value is set at a value obtained with "Standard particle 10.0 μm" (trade name, available from Beckman Coulter, Inc.). The "button for measurement of threshold/noise level" is pressed to automatically set the threshold and the noise level. The current is at 1600 μA, the gain is set at 2, and the electrolyte solution is set at ISOTON II. The "flush aperture tube after measurement" is checked.

With the dedicated software, on the "Set conversion from pulse to particle diameter" screen, the bin interval is set at the logarithmic particle diameter, the particle diameter bin is set at 256 particle diameter bins, and the particle diameter range is set at 2 μm to 60 μm.

A specific measuring method is described as follows.

(1) About 200 ml of the electrolytic aqueous solution is placed in a 250 ml glass round-bottomed beaker dedicated to Multisizer 3. The beaker is set on a sample stand. The electrolytic aqueous solution is stirred counterclockwise at 24 rotations/sec with a stirring rod. Dirt and air bubbles in the aperture tube are removed by the function "Flush aperture" of the dedicated software.

(2) About 30 ml of the electrolytic aqueous solution is placed in a 100 ml glass flat-bottomed beaker. About 0.3 ml of a diluted solution of a dispersant "CONTAMINON N" (trade name, 10% by mass aqueous solution of a neutral detergent for washing a precision measurement apparatus (pH: 7) composed of a nonionic surfactant, an anionic surfactant, and an organic builder, available from Wako Pure Chemical Industries, Ltd.) is added to the electrolytic aqueous solution. The diluted solution is prepared by diluting "CONTAMINON N" with ion exchange water about 3 times by mass.

(3) An ultrasonic disperser "Ultrasonic Dispersion System Tetora 150" (trade name, available from Nikkaki-Bios Co., Ltd.) is prepared. The ultrasonic disperser has an electrical output of 120 W and includes two incorporated oscillators having an oscillating frequency of 50 kHz with the phase of one oscillator being shifted 180° from the phase of the other oscillator. About 3.3 l of ion exchange water is placed in a water bath of the ultrasonic disperser, and about 2 ml of CONTAMINON N is added in the water bath.

(4) The beaker in (2) is set to a beaker fixing hole of the ultrasonic disperser to operate the ultrasonic disperser. The height of the beaker is adjusted so as to maximize the oscillating state of the surface of the electrolytic aqueous solution in the beaker.

(5) While the electrolytic aqueous solution in the beaker of (4) is irradiated with ultrasonic waves, a toner (about 10 mg) is added to the electrolytic aqueous solution little by little, and is dispersed. The ultrasonic dispersion is continued for another 60 seconds. During the ultrasonic dispersion, the temperate of water in the water bath is properly adjusted to 10° C. or more and 40° C. or less.

(6) The electrolytic aqueous solution having the dispersed toner (5) is added dropwise to the round-bottomed beaker set on the sample stand in (1) with a pipette, and the concentration for measurement is adjusted to be about 5%. The measurement is performed until the number of particles measured reaches 50000.

(7) The data measured is analyzed with the dedicated software attached to the analyzer, and the weight average particle diameter (D4) is calculated. When graph/% by volume is set with the dedicated software, the "average diameter" on the "analysis/volume statistical value (arithmetic average)" screen is the weight average particle diameter (D4).

[5] Method of Measuring Number Average Particle Diameter of Primary Particles of Silica Fine Particles The number average particle diameter of primary particles of the silica fine particles is calculated from images of the silica fine particles on the surfaces of the toner particles. The images are photographed with a Hitachi super high resolution field-emission scanning electron microscope (trade name: S-4800, available from Hitachi High-Technologies Corporation). The images are photographed with "S-4800" on the following conditions.

(1) Preparation of Sample

A conductive paste is slightly applied onto a sample stand (aluminum sample stand: 15 mm×6 mm), and a toner is sprayed on the paste. An excess of the toner is removed from the sample stand by blowing air, and the sample is sufficiently dried. The sample stand is set in a sample holder, and the height of the sample stand is adjusted to 36 mm with a sample height gauge.

(2) Setting Conditions on Observation with "S-4800"

The number average particle diameter of primary particles of the silica fine particles is calculated from the image obtained by observation of a backscattered electron image with "S-4800." Charge up of the silica fine particles barely occurs in the backscattered electron image compared to a secondary electron image, and the particle diameters of the silica fine particles can be measured accurately.

Liquid nitrogen is injected to an anti-contamination trap mounted on a mirror body of "S-4800" until liquid nitrogen overflows, and is left for 30 minutes. "PCSTEM" of "S-4800" is operated to flush (clean FE chips as an electron source). An accelerating voltage display unit in a control panel on the screen is clicked, and the [flushing] button is pressed to open a flushing operating dialogue. When it is confirmed that the flushing strength is 2, the flushing is executed. It is confirmed that the emission current by the flushing is 20 to 40 μA. The sample holder is inserted into a sample chamber of the mirror body of "S-4800." The [origin] on the control panel is pressed to move the sample holder to a position for observation.

The accelerating voltage display unit is clicked to open an HV setting dialogue, and the accelerating voltage is set at [0.8 kV] and the emission current is set at [20 μA]. The signal selection is set to [SE] in a tab [Basic] of the operation panel, and [UP (U)] and [+BSE] is selected for the SE detector. [L.A.100] is selected in the selection box on the right of [+BSE] to select a mode of observation with the backscattered electron image. In the tab [Basic] of the operation panel, the probe current in the electron optical system condition block is set to [Normal], the focus mode is set to [UHR], and WD is set to [3.0 mm]. The [ON] button of the accelerating voltage display unit on the control panel is pressed to apply an accelerating voltage.

(3) Calculation of Number Average Particle Diameter (D1) (Da) of Silica Fine Particles A place in the magnification display unit on the control panel is dragged to set the magnification to be 100000 (100 k) times. The focus knob [COARSE] on the operation panel is turned. When the focusing is obtained to some extent, the alignment of the aperture is adjusted. [Align] on the control panel is clicked to display the alignment dialogue, and select [Beam]. The STIGMA/ALIGNMENT knob (X,Y) on the operation panel is turned to move the displayed beam to the center of the concentric circle.

Next, [Aperture] is selected. The STIGMA/ALIGNMENT knob (X,Y) is turned one by one to perform alignment so as to stop or minimize the movement of the image. The aperture dialogue is closed, and focusing is obtained by autofocusing. This operation is further repeated twice to obtain focusing.

Subsequently, the particle diameters of at least 300 silica fine particles on the surfaces of the toner particles are measured to determine the average particle diameter. Here, some silica fine particles are present as clots. Accordingly, the largest diameters of the silica fine particles determined as primary particles are determined, and the largest diameters thereof are arithmetically averaged to obtain the number average particle diameter (D1) (da) of primary particles of the silica fine particles.

[6] Method of Measuring Average Circularity of Toner Particles

The average circularity of the toner particles is measured with a flow type particle image analyzer "FPIA-3000" (trade name, available from Sysmex Corporation) on the conditions on measurement and analysis during calibration.

A specific measuring method is described as follows. First, about 20 ml of ion exchange water from impurity solid products are preliminarily removed is placed in a glass container. About 0.2 ml of a diluted solution of a dispersant "CONTAMINON N" (10% by mass aqueous solution of a neutral detergent for washing a precision measurement apparatus (pH: 7) composed of a nonionic surfactant, an anionic surfactant, and an organic builder, available from Wako Pure Chemical Industries, Ltd.) is added to the ion exchange water. The diluted solution is prepared by diluting "CONTAMINON N" with ion exchange water about 3 times by mass. A sample for measurement (about 0.02 g) is added, and is dispersed with an ultrasonic disperser for 2 minutes to prepare a dispersion liquid for measurement.

At this time, the dispersion liquid is properly cooled to control the temperature of the dispersion liquid to be 10° C. or more and 40° C. or less. The ultrasonic disperser used is a desktop ultrasonic washing and dispersing machine (such as "VS-150" (available from VELVO-CLEAR K.K.)) having an oscillating frequency of 50 kHz and an electrical output of 150 W. A predetermined amount of ion exchange water is placed in the water bath, and about 2 ml of the "CONTAMINON N" is added into the water bath.

In the measurement, the flow type particle image analyzer provided with an object lens "UPlan Apro" (magnification: 10 times, the number of openings: 0.40) is used. A particle sheath "PSE-900A" (available from Sysmex Corporation) is used as a sheath solution. The dispersion liquid prepared according to the procedure is introduced into the flow type particle image analyzer, and 3000 toner particles are measured in an HPF measuring mode and a total count mode. The binarized threshold during particle analysis is 85%. The particle diameter for analysis is limited to an equivalent circle diameter 1.985 μm or more and less than 39.69 μm to determine the average circularity of the toner particles.

In the measurement, the focus is automatically adjusted with a standard latex particle (such as "RESEARCH AND TEST PARTICLES Latex Microsphere Suspensions 5200A available from Duke Scientific Co." diluted with ion exchange water) before the measurement is started. Subsequently, the focus can be adjusted every 2 hours from the start of the measurement.

In the present invention, a flow type particle image measurement apparatus corrected and certified by Sysmex Corporation is used. The measurement is performed on the conditions on measurement and analysis set when corrected and certified by Sysmex Corporation, except that the particle diameter for analysis is limited to an equivalent circle diameter 1.985 μm or more and less than 39.69 μm.

The principle of measurement employed by the flow type particle image measurement apparatus "FPIA-3000" (available from Sysmex Corporation) is that flowing particles are photographed as a still image and the image is analyzed. A sample placed in a sample chamber is fed to a flat sheath flow cell with a sample suction syringe. The sample fed to the flat sheath flow cell is sandwiched between flows of a sheath solution to form a flat flow. The sample passing through the flat sheath flow cell is irradiated with a strobe light at intervals of 1/60 seconds. Thereby, flowing particles can be photographed as a still image. The flow can be focused and photographed because the flow is flat. The image of particles is taken with a CCD camera, and is subjected to image processing at an image processing resolution of 512×512 pixels (0.37×0.37 μm per pixel). Each particle image is subjected to outline extraction to measure the projected area S and circumferential length L of the particle image.

Next, the equivalent circle diameter and the circularity are determined from the area S and the circumferential length L. The equivalent circle diameter refers to a diameter of a circle having the same area as the projected area of the particle image. The circularity is defined as a value obtained by dividing the circumferential length of a circle determined from the equivalent circle diameter by a circumferential length of a projected image of the particle. The circularity is calculated from the following expression:

$$\text{circularity}=2\times(\pi\times S)1/2/L$$

When the particle image is circular, the circularity is 1.000. As the degree of unevenness of the outer periphery of the particle image is larger, the circularity has a smaller value. After the circularity of each particle is calculated, a range of a circularity from 0.200 to 1.000 is divided into 800, and the arithmetic average value of the obtained circularities is calculated. The value is defined as the average circularity.

[7] Method of Measuring Apparent Density of Silica Fine Particles

In the measurement of the apparent density of the silica fine particles, a sample for measurement placed on a paper is slowly added into a 100 ml measuring cylinder until the sample reaches 100 ml. The difference between the mass of the measuring cylinder before addition of the sample and that after addition of the sample is determined from the following expression. The sample is carefully added into the measuring cylinder so as not to hit the paper.

apparent density (g/L)=(mass (g) when 100 ml of the sample is added)/0.1

<Method of Measuring True Specific Gravity of Toner and Silica Fine Particles>

The true specific gravity of the toner and that of the silica fine particles are measured with a dry automatic densitometer Auto Pycnometer (available from Yuasa Ionics Inc.). The conditions are as follows.

Cell: SM cell (10 ml)

Amount of the sample: about 2.0 g (toner), 0.05 g (silica fine particles)

The measurement method measures the true specific gravities of a solid and a liquid according to gas displacement. The gas displacement as well as fluid displacement is based on Archimedes' principle. The gas displacement uses a gas (argon gas) as a displacement medium and has high precision in the measurement of micropores.

[8] Method of Measuring Fixation Rate of Silica Fine Particles with Silicone Oil in Terms of Amount of Carbon (Extraction of Free Silicone Oil)

(1) Silica fine particles (0.50 g) and chloroform (40 ml) are placed in a beaker, and are stirred for 2 hours.

(2) Stirring is stopped, and the mixture is left as it is for 12 hours.

(3) The sample is filtered, and the product is washed with chloroform (40 ml) three times.

(Measurement of Amount of Carbon)

Under an oxygen stream, the sample is burned at 1100° C., and the amounts of CO and $CO_2$ generated are measured by absorbance of IR to determine the amount of carbon in the sample. The amounts of carbon are compared before and after the extraction of silicone oil, and the fixation rate of silicone oil in terms of the amount of carbon is calculated as follows.

(1) A sample (0.40 g) is placed in a cylindrical metal mold, and is pressed.

(2) The pressed sample (0.15 g) is precisely weighed, is placed on a board for burning, and is measured with a HORIBA EMA-110.

(3) The value obtained from ([amount of carbon after extraction of silicone oil]/[amount of carbon before extraction of silicone oil]×100) is defined as the fixation rate of silicone oil in terms of the amount of carbon.

When the silica fine particles are hydrophobized with a silane compound or the like and are surface treated with silicone oil, the amount of carbon in the sample is measured after the hydrophobization with a silane compound or the like. After the treatment with silicone oil, the amount of carbon before the extraction of silicone oil is compared to that after the extraction of silicone oil. The fixation rate in terms of the amount of carbon derived from silicone oil is calculated as follows.

(4) The value obtained from [amount of carbon after extraction of silicone oil]/[(amount of carbon before extraction of silicone oil−amount of carbon after hydrophobization with silane compound)]×100) is defined as the fixation rate of silicone oil in terms of the amount of carbon.

When the silica fine particles are hydrophobized with a silane compound or the like after the surface treatment with silicone oil, the fixation rate in terms of the amount of carbon derived from silicone oil is calculated as follows.

(5) The value obtained from ([(amount of carbon after extraction of silicone oil−amount of carbon after hydrophobization with silane compound)]/[amount of carbon before extraction of silicone oil]×100) is defined as the fixation rate of silicone oil in terms of the amount of carbon.

The present invention can form high-quality electrophotographic images under a variety of environments.

The present invention can attain an image forming apparatus and an image forming method that can output high-quality electrophotographic images.

EXAMPLES

The present invention will be described by way of Examples, but the present invention will not be limited to these Examples.

(Production Example of Toner)

<Preparation of Magnetic Substance 1>

A sodium hydroxide solution (1.00 to 1.10 equivalents relative to an iron element), $P_2O_5$ (0.15% by mass in terms of a phosphorus element relative to an iron element), and $SiO_2$ (0.50% by mass in terms of a silicon element relative to an iron element) were mixed with an aqueous solution of ferrous sulfate to prepare an aqueous solution containing ferrous hydroxide. The pH of the aqueous solution was adjusted to 8.0. An oxidation reaction was performed at 85° C. while air was being fed. A slurry solution having seed crystals was prepared.

Next, an aqueous solution of ferrous sulfate was added to the slurry solution in an amount of 0.90 to 1.20 equivalents relative to the initial alkali amount (sodium component in sodium hydroxide). Then, the pH of the slurry solution was kept at 7.6, and the oxidation reaction was advanced while air was being fed. A slurry solution containing magnetic iron oxide was prepared. After filtration and washing, the moisture slurry solution was extracted once. At this time, a small amount of the moisture sample was taken, and the amount of moisture was measured. Next, the moisture sample was placed in another aqueous medium without drying, and was stirred. The slurry was redispersed with a pin mill while being circulated. The pH of the redispersed liquid was adjusted to about 4.8. Under stirring, 1.6 parts by mass of an n-hexyltrimethoxysilane coupling agent was added relative to 100 parts by mass of magnetic iron oxide (the amount of magnetic iron oxide was calculated by subtracting the moisture content from the amount of the moisture sample), and was hydrolyzed. Subsequently, the mixture was sufficiently stirred, the pH of the dispersion liquid was adjusted to 8.6, and the surface treatment was performed. The generated hydrophobic magnetic substance was filtered through a filter press, and was washed with a large amount of water. The magnetic substance was dried at 100° C. for 15 minutes and at 90° C. for 30 minutes. The resulting particles are ground to prepare Magnetic substance 1 having a volume average particle diameter of 0.21 μm.

<Preparation of Polyester Resin 1>

The following components were placed in a reaction tank provided with a cooling tube, a stirrer, and a nitrogen introducing pipe, and were reacted at 230° C. under a nitrogen stream for 10 hours while water was being distilled off.

Bisphenol A propylene oxide 2 mol adduct: 75 parts by mass

Bisphenol A propylene oxide 3 mol adduct: 25 parts by mass

Terephthalic acid: 100 parts by mass

Titanium catalyst (titanium dihydroxybis(triethanolaminate)): 0.25 parts by mass Next, the reaction was made under a reduced pressure of 5 to 20 mmHg. When the acid value reached 2 mgKOH/g or less, the product was cooled to 180° C. Trimellitic anhydride (10 parts by mass) was added, and the reaction was performed under sealed normal pressure for 2 hours. The product was extracted, was cooled to room temperature, and was ground to prepare Polyester resin 1. The resulting Polyester resin 1 had a main peak molecular weight (Mp) of 10500, which was determined by gel permeation chromatography (GPC).

<Preparation of Toner Particle 1>

An aqueous solution of 0.1 M-$Na_2PO_4$ (450 parts by mass) was added to ion exchange water (720 parts by mass), and the mixture was heated to 60° C. An aqueous solution of 1.0 M-$CaCl_2$ (67.7 parts by mass) was added to prepare an aqueous medium containing a dispersion stabilizer.

Styrene: 78.0 parts by mass n-butyl acrylate: 22.0 parts by mass

Divinylbenzene: 0.6 parts by mass

Iron complex of a monoazo dye (T-77: available from HODOGAYA CHEMICAL CO., LTD.): 3.0 parts by mass Magnetic substance 1: 90.0 parts by mass Polyester resin 1: 5.0 parts by mass The formulation was uniformly dispersed and mixed with an "Attritor" (trade name, available from Mitsui Miike Kakoki K.K.) to prepare a polymerizable monomer composition. The resulting polymerizable monomer composition was heated to 60° C. A Fischer-Tropsch wax (melting point: 74° C., number average molecular weight Mn: 500) (15.0 parts by mass) was added, was mixed, and was dissolved. A polymerization initiator dilauroyl peroxide (7.0 parts by mass) was dissolved to prepare a toner composition.

The toner composition was added to the aqueous medium, and was stirred at 60° C. under an $N_2$ atmosphere with a TK homomixer (trade name, available from PRIMIX Corporation) at 12000 rpm for 10 minutes to be granulated. Subsequently, the mixture was reacted at 74° C. for 6 hours while the mixture was being stirred with a paddle stirring blade.

After the reaction was completed, the suspension was cooled, and hydrochloric acid was added to wash the suspension. The suspension was filtered, and was dried to prepare Toner particle 1. The resulting magnetic toner, i.e., Toner particle 1 had a weight average particle diameter of 8.0 μm and an average circularity of 0.970.

<Preparation of Toner A>

Toner particle 1 prepared in Production Example of Toner particle 1 was subjected to external addition by mixing with an apparatus illustrated in FIG. 5.

In this Example, the apparatus illustrated in FIG. 5 was provided with the main body casing 22 having a diameter of the inner circumferential portion of 130 mm and the treatment space 30 having a volume of $2.0\times10^{-3}$ $m^3$. The rating power of the driving unit 29 was 5.5 kW. The stirring member 24 had the shape illustrated in FIG. 6. The overlap width d of the stirring member 24*a* and the stirring member 24*b* in FIG. 6 was 0.25 D relative to the largest width D of the stirring member 24. The clearance formed by the stirring member 24 and the inner circumference of the main body casing 22 was 3.0 mm.

Toner particle 1 (100 parts by mass) and Silica fine particle 1 shown in Table 1 (number average particle diameter of primary particles of the silica raw material: 7 nm, BET specific surface area: 300 $m^2$/g, fixation rate of silicone oil in terms of the amount of carbon: 98%, apparent density: 25 g/L, number average particle diameter of primary particles of the silica fine particles after the surface treatment: 8 nm) (0.50 parts by mass) were placed in the apparatus illustrated in FIG. 5 and having the configuration above.

After Toner particle 1 and Silica fine particle 1 were placed, Toner particle 1 and Silica fine particle 1 were pre-mixed to uniformly mix these. For the condition on the pre-mixing, the power of the driving unit 29 was 0.10 W/g (number of rotation of the driving unit 29: 150 rpm), and the treatment time was 1 minute.

After the pre-mixing was completed, external addition by mixing were performed. For the conditions on the external addition by mixing, the circumferential speed of the outermost end of the stirring member 24 was adjusted such that the power of the driving unit 29 was kept constant at 0.60 W/g (number of rotation of the driving unit 29: 1400 rpm), and the treatment time was 5 minutes. The conditions on the external addition by mixing are shown in Table 2.

After completion of the external addition by mixing, coarse particles and the like were removed with a circular vibration sieving machine provided with a screen having a diameter of 500 mm and an opening of 75 μm to prepare Toner A. Toner 1 for Example was enlarged with a scanning electron microscope, and was observed. The number average particle diameter of primary particles of the silica fine particles on the surfaces of the toner particles was measured. It was 8 nm. The conditions on external addition and physical properties of Toner A are shown in Table 2.

<Preparation of Toners B to J and Toner k>

Toners B to J and Toner k were prepared in the same manner as in Production Example of Toner A except that types of silica shown in Table 1 were used and external addition was performed on the conditions shown in Table 2. The physical properties of the resulting Toners B to J and Toner k are shown in Table 2.

TABLE 1

| Silica fine particle No. | BET specific surface area of silica raw material ($m^2$/g) | Amount of silicone oil used to surface treat 100 parts by mass of silica raw material (parts by mass) | Kinematic viscosity of silicone oil (cSt) | Fixation rate of silicone oil in terms of amount of carbon (%) | Apparent density (g/L) |
|---|---|---|---|---|---|
| 1 | 300 | 20 | 50 | 98 | 25 |
| 2 | 380 | 28 | 50 | 98 | 20 |
| 3 | 100 | 17 | 50 | 98 | 40 |
| 4 | 300 | 40 | 50 | 98 | 25 |
| 5 | 300 | 20 | 50 | 70 | 25 |
| 6 | 300 | 13 | 50 | 98 | 25 |
| 7 | 300 | 45 | 50 | 98 | 25 |
| 8 | 300 | 20 | 50 | 60 | 25 |

TABLE 2

| Types of toner | Toner particle No. | Silica fine particles No. | Amount of silica fine particle added (parts by mass) | Content of silica fine particle (parts by mass) | Pre-mixing step | External addition step | Covering rate X1 (area %) | Diffusion index |
|---|---|---|---|---|---|---|---|---|
| Toner A | 1 | 1 | 0.50 | 0.50 | 0.10 W/g (150 rpm) | 0.60 W/g (1400 rpm) | 50 | 0.50 |
| Toner B | 1 | 2 | 0.40 | 0.40 | 0.06 W/g (50 rpm) | 0.60 W/g (1400 rpm) | 54 | 0.51 |
| Toner C | 1 | 3 | 1.30 | 1.30 | 0.06 W/g (50 rpm) | 0.60 W/g (1400 rpm) | 58 | 0.64 |
| Toner D | 1 | 4 | 0.60 | 0.60 | 0.10 W/g (150 rpm) | 0.60 W/g (1400 rpm) | 56 | 0.48 |
| Toner E | 1 | 5 | 0.60 | 0.60 | 0.10 W/g (150 rpm) | 0.60 W/g (1400 rpm) | 56 | 0.48 |
| Toner F | 1 | 1 | 0.45 | 0.45 | 0.10 W/g (150 rpm) | 0.60 W/g (1400 rpm) | 47 | 0.52 |
| Toner G | 1 | 1 | 0.90 | 0.90 | 0.10 W/g (150 rpm) | 0.60 W/g (1400 rpm) | 75 | 0.42 |
| Toner H | 1 | 6 | 0.60 | 0.60 | 0.10 W/g (150 rpm) | 0.60 W/g (1400 rpm) | 56 | 0.48 |
| Toner I | 1 | 7 | 0.60 | 0.60 | 0.10 W/g (150 rpm) | 0.60 W/g (1400 rpm) | 56 | 0.48 |
| Toner J | 1 | 8 | 0.60 | 0.60 | 0.10 W/g (150 rpm) | 0.60 W/g (1400 rpm) | 56 | 0.48 |
| Toner k | 1 | 1 | 0.40 | 0.40 | 0.10 W/g (150 rpm) | 0.60 W/g (1200 rpm) | 33 | 0.49 |

(Production Example of Developing Carrying Member)

<Preparation of Elastic Roller 1>

An aluminum cylindrical tube having an outer diameter 10 mmϕ (diameter) was ground to have an arithmetic average roughness Ra of 0.2 μm, and was used as Substrate 1. A primer (trade name, DY35-051; available from Dow Corning Toray Co., Ltd.) was applied to Substrate 1, and was burned.

Substrate 1 prepared above was disposed in a metal mold, and an addition silicone rubber composition containing a mixture of the following materials was injected into the cavity formed inside the metal mold.

Liquid silicone rubber material (trade name, SE6724 A/B; available from Dow Corning Toray Co., Ltd.) 100 parts by mass, Carbon black (trade name, TOKABLACK #4300; available from Tokai Carbon Co., Ltd.) 15 parts by mass, Silica powder as a heat resistance assigning agent 0.2 parts by mass, Platinum catalyst 0.1 parts by mass.

Subsequently, the metal mold was heated to vulcanize silicone rubber at a temperature 150° C. for 15 minutes. The silicon rubber was cured. The substrate having a cured silicone rubber layer on the circumferential surface thereof was removed from the metal mold. The substrate was further heated at a temperature of 180° C. for hour to complete the curing reaction of the silicone rubber layer. Thus, Elastic roller 1 having a diameter of 11.4 mm was prepared in which a silicone rubber elastic layer having a thickness of 0.7 mm was formed on the outer periphery of Substrate 1.

<Preparation of Surface Layer Coating Material>

As a raw material for a coating material for forming a surface layer (hereinafter also referred to as a "surface layer coating material"), an isocyanate group-terminated prepolymer and an amino compound were prepared as follows.

(Synthesis of Isocyanate Group-Terminated Prepolymer A-1)

Under a nitrogen atmosphere, polypropylene glycol polyol (trade name: EXCENOL 4030; available from ASAHI GLASS CO., LTD.) (100.0 parts by mass) was gradually added dropwise to tolylene diisocyanate (TDI) (trade name: COSMONATE T80; available from Mitsui Chemicals, Inc.) (17.7 parts by mass) in a reaction container while the inner temperature of the reaction container was kept at 65° C. After the addition was completed, these were reacted at a temperature of 65° C. for 2 hours. The reaction mixture was cooled to room temperature to prepare Isocyanate group-terminated prepolymer A-1 having a content of an isocyanate group of 3.8% by weight.

(Synthesis of Isocyanate Group-Terminated Prepolymer A-2)

Under a nitrogen atmosphere, (butylene adipate) polyol (trade name: NIPPOLAN 136; available from Nippon Polyurethane Industry Co., Ltd.) (100.0 parts by mass) was gradually added dropwise to polymeric MDI (trade name: Millionate MR, available from Nippon Polyurethane Industry Co., Ltd.) (26.0 parts by mass) in a reaction container while the inner temperature of the reaction container was kept at 65° C.

After the addition was completed, these were reacted at a temperature of 65° C. for 2 hours. The reaction mixture was cooled to room temperature to prepare Isocyanate group-terminated prepolymer A-2 having a content of an isocyanate group of 4.3% by mass.

(Synthesis of Amino Compound (Compound Represented by Formula (1)))

(Synthesis of Amino Compound B-1)

In a reaction container installed with a stirring apparatus, a thermometer, a refluxing tube, an adding apparatus, and a temperature adjusting apparatus, diethylenetriamine (100.0 parts by mass) and pure water (100 parts by mass) were heated to 40° C. while being stirred. Next, while the reaction temperature was kept at 40° C. or less, propylene oxide (295.6 parts by mass) was gradually added dropwise for 30 minutes. The mixture was further stirred for 1.5 hours to be reacted. A reaction mixture was prepared. The reaction mixture was heated under reduced pressure to distill off water. Amino compound B-1 was prepared.

(Synthesis of Amino Compounds B-2 to 5, B-11 to 14)

Amino compounds B-2 to 5 and B-11 to 14 were prepared in the same manner as in synthesis of Amino compound B-1 except that types of amino compound as a raw material and types of addition material, the compounding amount, and the reaction time were changed as shown in Table 3.

(Synthesis of Amino Compound B-6)

In a reaction container installed with a stirring apparatus, a thermometer, a refluxing tube, an adding apparatus, and a temperature adjusting apparatus, tetraethylenepentamine (100.0 parts by mass) and ethanol (100 parts by mass) were heated to 40° C. while being stirred. Next, while the reaction temperature was kept at 60° C. or less, 8-bromo-1-octanol (812.8 parts by mass) was gradually added dropwise over 30 minutes. The mixture was further stirred for 3 hours to be reacted. A reaction mixture was prepared. The reaction mixture was heated under reduced pressure to distill off ethanol. Amino compound B-6 was prepared.

(Synthesis of Amino Compound B-7)

In a reaction container installed with a stirring apparatus, a thermometer, a refluxing tube, an adding apparatus, and a temperature adjusting apparatus, ethylenediamine (100.0 parts by mass) and pure water (100 parts by mass) were heated to 40° C. while being stirred. Next, while the reaction temperature was kept at 60° C. or less, paraformaldehyde (210.0 parts by mass) was gradually added dropwise over 30 minutes. The mixture was further stirred for 1 hour to be reacted. A reaction mixture was prepared. The reaction mixture was heated under reduced pressure to distill off pure water. Amino compound B-7 was prepared.

(Synthesis of Amino Compound B-8)

Amino compound B-8 was prepared in the same manner as in synthesis of Amino compound B-6 except that types of amino compound as a raw material and types of addition material, the compounding amount, and the reaction time were changed as shown in Table 3.

(Synthesis of Amino Compound B-9)

In a reaction container installed with a stirring apparatus, a thermometer, a refluxing tube, an adding apparatus, and a temperature adjusting apparatus, butylenediamine (100.0 parts by mass) and pure water (100 parts by mass) were heated to 40° C. while being stirred. Next, while the reaction temperature was kept at 40° C. or less, ethyleneimine (205.2 parts by mass) was gradually added dropwise over 30 minutes. The mixture was further stirred for 1 hour to be reacted. A reaction mixture was prepared. The reaction mixture was heated under reduced pressure to distill off pure water. Amino compound B-9 was prepared.

(Synthesis of Amino Compound B-10)

In a reaction container installed with a stirring apparatus, a thermometer, a refluxing tube, an adding apparatus, and a temperature adjusting apparatus, butylenediamine (100.0 parts by mass) and ethanol (100 parts by mass) were heated to 40° C. while being stirred. Next, while the reaction temperature was kept at 40° C. or less, 8-bromo-1-aminooctane (992.7 parts by mass) was gradually added dropwise over 30 minutes. The mixture was further stirred for 1.5 hours to be reacted. A reaction mixture was prepared. The reaction mixture was heated under reduced pressure to distill off ethanol. Amino compound B-10 was prepared.

(Synthesis of Amino Compound Used in Comparative Example)

(Synthesis of Amino Compound b-1)

Amino compound b-1 was prepared in the same manner as in synthesis of Amino compound B-6 except that types of amino compound as a raw material and types of addition material, the compounding amount, and the reaction time were changed as shown in Table 3.

(Synthesis of Amino Compound b-2)

Amino compound b-2 was prepared in the same manner as in synthesis of Amino compound B-10 except that types of amino compound as a raw material and types of addition material, the compounding amount, and the reaction time were changed as shown in Table 3.

(Synthesis of Amino Compound b-3)

Amino compound b-3 was prepared in the same manner as in synthesis of Amino compound B-1 except that types of amino compound as a raw material and types of addition material, the compounding amount, and the reaction time were changed as shown in Table 3. The structures of Amino compounds B-1 to B-14 prepared are shown in Table 4. In Table 4, "n" represents a number of repetitions of the amino structure unit in Formula (1), and "m" represents a number of ether repetitions where R1 is Formula (2).

The structures of Amino compounds b-1 to b-3 for Comparative Examples are also shown in Table 4. Amino compounds b-1 to b-3 are out of the range defined by the compound represented by Formula (1). For convenience, the structures corresponding to "n," "m," R1, R3, and R2 are shown as the structures of "n," "m," R1, R3, and R2 in Table 4.

In Table 4, the cardinal number represents the number of terminal hydroxyl groups or terminal amino groups in one molecule of an amino compound.

TABLE 3

| | Types of amino compound as raw material | | Addition raw material | | |
|---|---|---|---|---|---|
| Amino compound | Compound | Parts by mass | Compound | Parts by mass | Reaction time |
| B-1 | Diethylenetriamine | 100.0 | Propylene oxide | 295.6 | 1.5 h |
| B-2 | Diethylenetriamine | 100.0 | Ethylene oxide | 224.3 | 1.5 h |
| B-3 | Ethylenediamine | 100.0 | Propylene oxide | 406.0 | 1 h |
| B-4 | Ethylenediamine | 100.0 | Ethylene oxide | 308.0 | 1 h |
| B-5 | Triethylenetetramine | 100.0 | Propylene oxide | 250.3 | 1.5 h |
| B-6 | Tetraethylenepentamine | 100.0 | 8-Bromo-1-octanol | 812.8 | 3 h |
| B-7 | Ethylenediamine | 100.0 | Paraformaldehyde | 210.0 | 1 h |
| B-8 | Ethylenediamine | 100.0 | 8-Bromo-1-octanol | 1463.0 | 1.5 h |
| B-9 | Butylenediamine | 100.0 | Ethyleneimine | 205.2 | 1 h |
| B-10 | Butylenediamine | 100.0 | 8-Bromo-1-aminooctane | 992.7 | 1.5 h |
| B-11 | Ethylenediamine | 100.0 | Propylene oxide | 812.0 | 2 h |
| B-12 | Ethylenediamine | 100.0 | 2-Methyl-tetrahydrofuran | 1204.0 | 2 h |
| B-13 | Triethylenetetramine | 100.0 | 2-Methyl-tetrahydrofuran | 1113.3 | 2.5 h |
| B-14 | Ethylenediamine | 100.0 | Ethylene oxide | 616.0 | 2 h |
| b-1 | Pentaethylenehexamine | 100.0 | 9-Bromo-1-nonanol | 807.4 | 3 h |
| b-2 | Pentamethylenediamine | 100.0 | 9-Bromo-1-aminononane | 914.1 | 1.5 h |
| b-3 | Ethylenediamine | 100.0 | Hexamethylene oxide | 2800.0 | 3 h |

TABLE 4

| Amino compound | n | R1 Structure | R3 Structure | m | R2 | Terminal functional group | Cardinal number |
|---|---|---|---|---|---|---|---|
| B-1 | 2 | —$CH_2CH(CH_3)$—OH | — | — | —$CH_2CH_2$— | OH | 5 |
| B-2 | 2 | —$CH_2CH_2$—OH | — | — | —$CH_2CH_2$— | OH | 5 |
| B-3 | 1 | —$CH_2CH(CH_3)$—OH | — | — | —$CH_2CH_2$— | OH | 4 |
| B-4 | 1 | —$CH_2CH_2$—OH | — | — | —$CH_2CH_2$— | OH | 4 |
| B-5 | 3 | —$CH_2CH(CH_3)$—OH | — | — | —$CH_2CH_2$— | OH | 6 |
| B-6 | 4 | —$(CH_2)_8$—OH | — | — | —$CH_2CH_2$— | OH | 7 |
| B-7 | 1 | —$CH_2$—OH | — | — | —$CH_2CH_2$— | OH | 4 |
| B-8 | 1 | —$(CH_2)_8$—OH | — | — | —$CH_2CH_2$— | OH | 4 |
| B-9 | 1 | —$CH_2CH_2$—$NH_2$ | — | — | —$(CH_2)_4$— | NH2 | 4 |
| B-10 | 1 | —$(CH_2)_8$—$NH_2$ | — | — | —$(CH_2)_4$— | NH2 | 4 |
| B-11 | 1 | — | —$CH_2CH(CH_3)$— | 2 | —$CH_2CH_2$— | OH | 4 |
| B-12 | 1 | — | —$CH_2CH_2CH(CH_3)CH_2$— | 2 | —$CH_2CH_2$— | OH | 4 |
| B-13 | 3 | — | —$CH_2CH_2CH(CH_3)CH_2$— | 3 | —$CH_2CH_2$— | OH | 6 |
| B-14 | 1 | — | —$CH_2CH_2$— | 2 | —$CH_2CH_2$— | OH | 4 |
| b-1 | 5 | —$(CH_2)_9$—OH | — | — | —$CH_2CH_2$— | OH | 8 |
| b-2 | 1 | —$(CH_2)_9$—$NH_2$ | — | — | —$(CH_2)_5$— | NH2 | 4 |
| b-3 | 1 | — | —$(CH_2)_6$— | 4 | —$CH_2CH_2$— | OH | 4 |

(Preparation of Developing Carrying Member S-1)

As materials for the surface layer 4, Amino compound B-1 (783.4 parts by mass), carbon black (trade name, MA230; available from Mitsubishi Chemical Corporation) (117.4 parts by mass) to give conductivity, and an urethane resin fine particle (trade name, Art-pearl C-400; available from Negami Chemical Industrial Co., Ltd.) (130.4 parts by mass) to give roughness to the surface of the developing carrying member were mixed with Isocyanate group-terminated prepolymer A-1 (51.6 parts by mass) by stirring.

Next, methyl ethyl ketone (hereinafter referred to as MEK) was added so that the total solid content was 30% by mass, and the materials were mixed with a sand mill. The viscosity was adjusted to 10 to 13 cps with MEK to prepare a coating material for forming a surface layer.

Elastic roller 1 preliminarily prepared was immersed in the coating material for forming a surface layer to form a coating of the coating material on the surface of the elastic layer of Elastic roller 1 and was dried. The coating was heated at a temperature of 160° C. for 1 hour to dispose a surface layer having a thickness of about 15 μm on the outer periphery of the elastic layer. Developing carrying member S-1 was prepared.

<Preparation of Developing Carrying Members S-2 to S-14>

Coating materials for forming a surface layer were prepared in the same manner as in preparation of Developing carrying member S-1 except that materials for the surface layer 4 shown in Table 5-1 were used. The respective coating materials were applied to the elastic layers, were dried, and were heated in the same manner as in preparation of Developing carrying member S-1 to prepare Developing carrying members S-2 to S-14.

<Preparation of Developing Carrying Members S'-1 to S'-3>

Coating materials for forming a surface layer were prepared in the same manner as in preparation of Developing carrying member S-1 except that the materials for the surface layer 4 shown in Table 5-2 were used. The respective coating materials were applied to the elastic layers, were dried, and were heated in the same manner as in preparation of Developing carrying member S-1 to prepare Developing carrying member S'-1 to S'-3.

<Preparation of Developing Carrying Member S'-4>

A coating material for forming a surface layer was prepared in the same manner as in preparation of Developing carrying member S-1 except that the material for the surface layer 4 was changed from Amino compound B-1 to pentaerythritol. The coating material was applied to the elastic layer, was dried, and was heated in the same manner as in preparation of Developing carrying member S-1 to prepare Developing carrying member S'-4. Pentaerythritol has no nitrogen atom in the structure.

The surface roughnesses (Ra) of Developing carrying members S-1 to S-14 and S'-1 to S'-4 thus prepared are shown in Table 5-1 and Table 5-2.

The surface layers of Developing carrying members S-1 to S-14 were analyzed with a pyrolysis apparatus (trade name: Pyrofoil Sampler JPS-700, available from Japan Analytical Industry Co., Ltd.) and a GC/MS apparatus (trade name: Focus GC/ISQ, available from Thermo Fisher Scientific Inc.) at a pyrolysis temperature of 590° C. Helium was used as a carrier gas. As a result, the obtained fragment peaks indicate that the surface layers of Developing carrying members S-1 to S-14 have structures derived from the reaction of a polyisocyanate with a compound represented by Formula (1).

TABLE 5-1

| Developer carrying member No. | Isocyanate group-terminated prepolymer No. | Parts by mass | Compound represented by Formula (1) No. | Parts by mass | Surface roughness Ra (μm) |
|---|---|---|---|---|---|
| S-1 | A-1 | 51.6 | B-1 | 783.4 | 2.52 |
| S-2 | A-1 | 60.6 | B-2 | 1034.2 | 2.74 |
| S-3 | A-1 | 62.3 | B-3 | 1031.0 | 2.64 |
| S-4 | A-1 | 50.4 | B-4 | 1054.2 | 2.54 |
| S-5 | A-1 | 93.4 | B-5 | 971.4 | 2.65 |
| S-6 | A-1 | 197.7 | B-6 | 771.3 | 2.55 |
| S-7 | A-1 | 43.9 | B-7 | 1066.0 | 2.62 |
| S-8 | A-2 | 56.5 | B-8 | 454.1 | 2.66 |
| S-9 | A-2 | 46.6 | B-9 | 960.0 | 2.58 |
| S-10 | A-2 | 106.5 | B-10 | 856.1 | 2.54 |
| S-11 | A-2 | 113.3 | B-11 | 844.3 | 2.61 |
| S-12 | A-2 | 140.3 | B-12 | 797.5 | 2.63 |
| S-13 | A-2 | 144.1 | B-13 | 790.9 | 2.58 |
| S-14 | A-2 | 145.3 | B-14 | 780.2 | 2.57 |

TABLE 5-2

| Developer carrying member No. | Isocyanate group-terminated prepolymer No. | Parts by mass | Compound similar to compound represented by Formula (1) No. | Parts by mass | Surface roughness Ra (μm) |
|---|---|---|---|---|---|
| S'-1 | A-1 | 232.3 | b-1 | 704.9 | 2.55 |
| S'-2 | A-2 | 100.4 | b-2 | 866.5 | 2.61 |
| S'-3 | A-1 | 222.6 | b-3 | 723.6 | 2.62 |
| S'-4 | A-2 | 32.4 | b-4 | 984.7 | 2.57 |

Example 1

The developing carrying members prepared above were mounted on a process cartridge to evaluate images.

As an image forming apparatus for evaluation, a laser printer (trade name: LaserJet Pro P1606, available from Hewlett-Packard Company) was modified as follows for use. One of the modification was that the developing bias was changed from AC to DC. Another modification was that the developing bias was −500 V, the bright potential on the drum was −300 V, and the dark potential on the drum was −800 V. Namely, the image forming apparatus used in this evaluation has a Vcontrast of 200 V and Vback of 300 V.

In a process cartridge for the image forming apparatus, the cleaning blade disposed in contact with the electrophotographic photosensitive member in the process cartridge was removed.

Six modified process cartridges were prepared. Developing carrying member S-1 having a magnet roller therein was mounted on each of the process cartridges, and was filled with Toner A.

Although the original developing apparatus mounted on the process cartridge for the image forming apparatus is a magnetic non-contact developing apparatus, it is converted into a magnetic contact developing apparatus by mounting Developing carrying member S-1 formed of an elastic roller having an outer diameter of 11 mm.

The following evaluations <1> and <2> were performed on the six process cartridges under environments such as a low temperature/low humidity environment (L/L) at 15° C. and 10% RH, a normal temperature/normal humidity environment (N/N) at 23° C. and 50% RH, and a high temperature/high humidity environment (H/H) at 32° C. and 85% RH.

<1> Evaluation of Fogging of Electrophotographic Image (1-1) "Evaluation of Fogging after Formation of White Solid Image"

An image forming step of forming a white solid image in a paper of A4 size was continuously performed to obtain 11 white solid images. In the 11th white solid image, 10 white solid portions in the portion corresponding to one rotation of the developing carrying member were selected at random, and the reflectances were measured. The reflectance of an unused paper (average value of reflectances of 10 places) was subtracted from the lowest reflectance of the 10 reflectances. The obtained value was defined as a "density after formation of a white solid image."

(1-2) "Evaluation after Formation of Black Solid Image"

An image forming step of forming a black solid image on a paper of A4 size was continuously performed to obtain 10 black solid images. Subsequently, one white solid image was output. In the white solid image, 10 white solid portions in the portion corresponding to one rotation of the developing carrying member were selected at random, the reflectances were measured. The reflectance of an unused paper (average value of reflectances of 10 places) was subtracted from the lowest reflectance of the 10 reflectances. The obtained value was defined as a "density after formation of a black solid image."

The reflectance was measured with a reflectometer "TC-6DS" (trade name, available from Tokyo Denshoku Co., Ltd.).

<2> Charge Amount (2-1)

In the evaluation in (1-1), when the 11th white solid image was formed, the toner adhering to the developing carrying member was suctioned and collected with a metal cylindrical tube and a cylindrical filter. At this time, the charge amount Q stored in a capacitor through the metal cylindrical tube and the mass M of the collected toner were measured. From these values, the charge amount Q/M (mC/kg) per unit mass was calculated.

(2-2)

In the evaluation in (1-2), when the white solid image was formed, the toner adhering to the developing carrying member was suctioned and collected with a metal cylindrical tube and a cylindrical filter. At this time, the charge amount Q stored in a capacitor through the metal cylindrical tube and the mass M of the collected toner were measured. From these values, the charge amount Q/M (mC/kg) per unit mass was calculated.

The results of evaluation on fogging and the charge amount are shown in Tables 7 and 8.

If the developing carrying member has a poor ability to give charge to the toner and the toner is difficult to roll on the surface of the developing carrying member, the toner cannot have a sufficient charge amount particularly under a high temperature and high humidity environment, increasing fogging after formation of a white solid image. If the adhesion of the toner and the external additive is weak and the fluidity of the toner is insufficient, the charge amount of the toner stagnating in the control portion is abnormally increased particularly under a low temperature and low humidity environment. As a result, the toner adheres to the surface of developing carrying member to increase fogging after formation of a black solid image.

Examples 2 to 30, Comparative Examples 1 to 8

Evaluations were performed in the same manner as in Example 1 except that each combination of a developing carrying member and a toner shown in Table 6 was used. The results of evaluation on fogging and the charge amount are shown in Tables 7 and 8.

TABLE 6

| | Toner No. | Developing carrying member No. |
|---|---|---|
| Example 1 | A | S-1 |
| Example 2 | A | S-2 |
| Example 3 | A | S-3 |
| Example 4 | A | S-4 |
| Example 5 | A | S-5 |
| Example 6 | A | S-6 |
| Example 7 | A | S-7 |
| Example 8 | A | S-8 |
| Example 9 | A | S-9 |
| Example 10 | A | S-10 |
| Example 11 | A | S-11 |
| Example 12 | A | S-12 |
| Example 13 | A | S-13 |

TABLE 6-continued

| | Toner No. | Developing carrying member No. |
|---|---|---|
| Example 14 | A | S-14 |
| Example 15 | B | S-1 |
| Example 16 | C | S-1 |
| Example 17 | D | S-1 |
| Example 18 | E | S-1 |
| Example 19 | F | S-1 |
| Example 20 | G | S-1 |
| Example 21 | F | S-6 |
| Example 22 | F | S-7 |
| Example 23 | F | S-8 |
| Example 24 | F | S-9 |
| Example 25 | F | S-10 |
| Example 26 | F | S-13 |

TABLE 6-continued

| | Toner No. | Developing carrying member No. |
|---|---|---|
| Example 27 | F | S-14 |
| Example 28 | H | S-1 |
| Example 29 | I | S-1 |
| Example 30 | J | S-1 |
| Comparative Example 1 | F | S'-1 |
| Comparative Example 2 | F | S'-2 |
| Comparative Example 3 | F | S'-3 |
| Comparative Example 4 | F | S'-4 |
| Comparative Example 5 | k | S-1 |
| Comparative Example 6 | k | S'-1 |
| Comparative Example 7 | k | S'-2 |
| Comparative Example 8 | k | S'-3 |

TABLE 7

| | Evaluation <1> (1-1) fogging after formation of white solid image (%) | | | Evaluation <1> (1-2) fogging after formation of black solid image (%) | | |
|---|---|---|---|---|---|---|
| | L/L | N/N | H/H | L/L | N/N | H/H |
| Example 1 | 3.5 | 3.8 | 4.6 | 4.5 | 4.2 | 3.8 |
| Example 2 | 3.6 | 3.9 | 4.4 | 4.6 | 4.3 | 3.9 |
| Example 3 | 4.1 | 4.3 | 5.2 | 4.8 | 4.5 | 4.0 |
| Example 4 | 4.2 | 4.4 | 5.6 | 4.5 | 4.2 | 4.0 |
| Example 5 | 4.5 | 4.8 | 5.8 | 5.2 | 4.8 | 4.4 |
| Example 6 | 4.6 | 4.7 | 5.9 | 5.3 | 4.7 | 4.4 |
| Example 7 | 4.4 | 4.7 | 6.0 | 5.1 | 4.7 | 4.4 |
| Example 8 | 4.8 | 5.2 | 6.4 | 5.8 | 5.0 | 4.6 |
| Example 9 | 4.7 | 5.3 | 6.3 | 6.2 | 5.2 | 4.5 |
| Example 10 | 4.8 | 5.3 | 6.5 | 6.4 | 5.3 | 4.3 |
| Example 11 | 4.8 | 5.4 | 6.4 | 6.6 | 5.2 | 4.4 |
| Example 12 | 4.7 | 5.6 | 6.4 | 6.7 | 5.4 | 4.5 |
| Example 13 | 4.9 | 5.7 | 6.6 | 6.8 | 5.7 | 4.7 |
| Example 14 | 4.8 | 5.7 | 6.7 | 6.8 | 5.6 | 4.8 |
| Example 15 | 4.7 | 5.6 | 6.8 | 6.8 | 5.7 | 4.9 |
| Example 16 | 3.7 | 3.9 | 4.7 | 5.8 | 5.2 | 4.8 |
| Example 17 | 3.7 | 3.8 | 4.8 | 5.7 | 5.2 | 4.9 |
| Example 18 | 3.8 | 4.2 | 4.9 | 5.7 | 5.4 | 5.0 |
| Example 19 | 3.8 | 4.1 | 4.7 | 5.6 | 5.3 | 4.8 |
| Example 20 | 4.0 | 4.3 | 4.8 | 6.0 | 5.7 | 4.9 |
| Example 21 | 4.2 | 4.4 | 7.2 | 5.8 | 5.2 | 4.8 |
| Example 22 | 4.5 | 4.7 | 7.5 | 7.2 | 6.5 | 5.0 |
| Example 23 | 4.8 | 6.0 | 8.2 | 8.0 | 6.8 | 4.8 |
| Example 24 | 4.5 | 5.8 | 7.9 | 8.2 | 6.6 | 4.5 |
| Example 25 | 4.4 | 5.9 | 8.1 | 8.3 | 6.5 | 4.8 |
| Example 26 | 4.8 | 6.2 | 8.5 | 8.2 | 6.3 | 4.9 |
| Example 27 | 4.7 | 5.8 | 8.1 | 7.9 | 6.2 | 4.7 |
| Example 28 | 6.2 | 6.4 | 6.8 | 6.7 | 6.3 | 4.8 |
| Example 29 | 5.7 | 6.0 | 6.5 | 6.8 | 6.5 | 4.7 |
| Example 30 | 6.0 | 6.2 | 6.5 | 6.6 | 6.1 | 4.6 |
| Comparative Example 1 | 12.3 | 15.3 | 22.5 | 6.8 | 6.5 | 6.2 |
| Comparative Example 2 | 11.8 | 14.6 | 21.5 | 6.9 | 6.8 | 6.6 |
| Comparative Example 3 | 13.5 | 16.4 | 24.2 | 6.7 | 6.5 | 6.2 |
| Comparative Example 4 | 15.8 | 25.8 | 32.4 | 35.2 | 22.3 | 18.5 |
| Comparative Example 5 | 5.8 | 6.2 | 6.8 | 21.5 | 14.5 | 12.3 |
| Comparative Example 6 | 8.2 | 12.5 | 24.3 | 22.5 | 13.5 | 9.0 |
| Comparative Example 7 | 8.4 | 11.8 | 22.5 | 23.5 | 14.5 | 8.8 |
| Comparative Example 8 | 8.3 | 12.4 | 23.6 | 24.8 | 15.8 | 9.0 |

TABLE 8

| | Evaluation <2> (2-1) Q/M after formation of white solid image (mC/kg) | | | Evaluation <2> (2-2) Q/M after formation of black solid image (mC/kg) | | |
|---|---|---|---|---|---|---|
| | L/L | N/N | H/H | L/L | N/N | H/H |
| Example 1 | 25.4 | 17.3 | 9.8 | 15.2 | 12.5 | 7.5 |
| Example 2 | 25.3 | 16.8 | 9.5 | 14.8 | 12.8 | 7.2 |
| Example 3 | 24.3 | 16.3 | 7.8 | 15.3 | 12.4 | 7.7 |
| Example 4 | 24.2 | 16.6 | 7.3 | 14.8 | 13.5 | 7.5 |
| Example 5 | 25.3 | 17.5 | 7.2 | 16.2 | 12.8 | 7.2 |

TABLE 8-continued

| | Evaluation <2> (2-1) Q/M after formation of white solid image (mC/kg) | | | Evaluation <2> (2-2) Q/M after formation of black solid image (mC/kg) | | |
|---|---|---|---|---|---|---|
| | L/L | N/N | H/H | L/L | N/N | H/H |
| Example 6 | 25.3 | 17.2 | 7.4 | 16.5 | 13.0 | 6.9 |
| Example 7 | 24.8 | 17.0 | 7.3 | 17.5 | 12.4 | 6.8 |
| Example 8 | 25.3 | 15.2 | 7.2 | 16.8 | 12.1 | 7.0 |
| Example 9 | 25.5 | 14.3 | 7.5 | 17.2 | 14.5 | 7.1 |
| Example 10 | 25.6 | 15.6 | 7.6 | 17.0 | 14.4 | 6.5 |
| Example 11 | 24.3 | 15.0 | 7.5 | 17.1 | 14.1 | 7.1 |
| Example 12 | 25.3 | 14.8 | 7.4 | 16.5 | 14.7 | 7.2 |
| Example 13 | 25.2 | 15.8 | 7.9 | 16.8 | 14.8 | 6.6 |
| Example 14 | 25.8 | 14.3 | 7.8 | 16.7 | 15.2 | 6.3 |
| Example 15 | 24.8 | 16.9 | 8.2 | 17.0 | 14.8 | 7.1 |
| Example 16 | 25.6 | 17.0 | 8.5 | 17.1 | 14.2 | 7.2 |
| Example 17 | 25.2 | 17.5 | 9.5 | 17.2 | 14.6 | 7.5 |
| Example 18 | 25.3 | 16.5 | 8.8 | 16.4 | 14.6 | 6.8 |
| Example 19 | 24.8 | 17.2 | 8.7 | 16.5 | 14.8 | 6.9 |
| Example 20 | 25.8 | 16.5 | 9.2 | 16.8 | 15.2 | 7.4 |
| Example 21 | 24.8 | 17.2 | 6.5 | 16.3 | 15.1 | 6.1 |
| Example 22 | 25.1 | 16.6 | 6.2 | 18.2 | 15.0 | 6.0 |
| Example 23 | 25.2 | 14.4 | 6.8 | 18.5 | 14.8 | 6.2 |
| Example 24 | 24.3 | 15.2 | 6.3 | 18.3 | 14.6 | 6.0 |
| Example 25 | 25.3 | 14.8 | 6.3 | 18.3 | 15.2 | 6.1 |
| Example 26 | 25.6 | 15.8 | 6.8 | 19.2 | 15.5 | 6.2 |
| Example 27 | 25.9 | 14.9 | 6.6 | 19.6 | 14.4 | 6.2 |
| Example 28 | 22.5 | 15.8 | 7.6 | 18.3 | 14.5 | 6.3 |
| Example 29 | 23.2 | 14.3 | 7.2 | 18.7 | 14.3 | 6.4 |
| Example 30 | 23.1 | 14.6 | 7.3 | 18.3 | 14.3 | 6.5 |
| Comparative Example 1 | 18.5 | 11.5 | 4.8 | 16.5 | 14.2 | 8.1 |
| Comparative Example 2 | 18.3 | 10.8 | 4.9 | 16.8 | 14.4 | 8.2 |
| Comparative Example 3 | 18.0 | 11.8 | 4.5 | 17.2 | 14.0 | 8.0 |
| Comparative Example 4 | 17.2 | 8.5 | 3.2 | 22.5 | 20.1 | 10.5 |
| Comparative Example 5 | 22.3 | 15.2 | 7.5 | 24.3 | 18.5 | 10.2 |
| Comparative Example 6 | 20.5 | 10.2 | 4.8 | 20.2 | 18.0 | 9.5 |
| Comparative Example 7 | 21.5 | 11.2 | 4.7 | 20.8 | 18.6 | 9.2 |
| Comparative Example 8 | 20.8 | 10.5 | 4.6 | 20.4 | 19.0 | 9.1 |

Tables 7 and 8 evidently show that Example 1 to Example 30 have good results in the evaluations.

In Comparative Example 1, the charge amount of the toner is insufficient and the result of evaluation on fogging after formation of a white solid image is relatively bad. This is probably because the urethane resin contained in the surface layer of the developing carrying member contains a raw material amine compound having a high degree (5) of polymerization "n" and the hydroxyalkyl group for R1 has many (9) carbon atoms, leading to insufficient hardness of the hard segment of the urethane resin.

In Comparative Example 2, the charge amount of the toner is insufficient and the result of evaluation on fogging after formation of a white solid image is relatively bad. This is probably because the urethane resin contained in the surface layer of the developing carrying member contains a raw material amine compound in which an aminoalkyl group for R1 has many (9) carbon atoms and an alkylene group for R2 has many (5) carbon atoms, and the crosslinking structure of the hard segment of the urethane resin is not sufficiently formed.

In Comparative Example 3, the charge amount of the toner is insufficient and the result of evaluation on fogging after formation of a white solid image is relatively bad. This is probably because the urethane resin contained in the surface layer of the developing carrying member contains a raw material amine compound in which an alkylene group for R2 has many (6) carbon atoms and the degree of polymerization m is high (4), and the crosslinking structure of the hard segment is not well formed.

In Comparative Example 4, a compound other than an amine compound is used as a raw material for the urethane resin contained in the surface layer of the developing carrying member. Accordingly, the resin in Comparative Example 4 does not have any amine skeleton in the resin structure. Probably for this reason, the developing carrying member has a poor ability to give charge to the toner, and the results of evaluation on fogging after formation of a white solid image and fogging after formation of a black solid image are relatively bad.

In Comparative Example 5, the covering rate of the toner with the silica fine particles is low (33%), and the disaggregation of the toner is insufficient. Probably for this reason, the result of evaluation on fogging after formation of a black solid image is relatively bad.

In Comparative Example 6, the results of evaluation on fogging after formation of a white solid image and fogging after formation of a black solid image are relatively bad. This is probably because the urethane resin contained in the surface layer of the developing carrying member contains a raw material amine compound in which the degree of polymerization n is high (5) and a hydroxyalkyl group for R1 has many carbon atoms (9). For these reasons, the crosslinking structure of the hard segment is not well formed. The toner has a low covering rate (33%) with the silica fine particles, and the disaggregation of the toner is insufficient.

In Comparative Example 7, the results of evaluation on fogging after formation of a white solid image and fogging after formation of a black solid image are relatively bad. This is probably because the urethane resin contained in the surface layer of the developing carrying member contains a raw material amine compound in which an aminoalkyl group for R1 has many (9) carbon atoms and an alkylene group for R2 has many (5) carbon atoms. For these reasons, the crosslinking structure of the hard segment is not well formed. The toner has a low covering rate (33%) with the silica fine particles, and the disaggregation of the toner is insufficient.

In Comparative Example 8, the results of evaluation on fogging after formation of a white solid image and fogging after formation of a black solid image are relatively bad. This is probably because the urethane resin contained in the surface layer of the developing carrying member contains a raw material amine compound in which an alkylene group for R2 has many (6) carbon atoms and the degree of polymerization m is high (4), and the crosslinking structure of the hard segment is not well formed. The toner has a low covering rate (33%) with the silica fine particles, and the disaggregation of the toner is insufficient.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-270545, filed Dec. 26, 2013, which is hereby incorporated by reference herein in its entirety.

What is claimed is:

1. A developing apparatus comprising:

a toner, a developing container accommodating the toner, a developing carrying member rotatably held, the developing carrying member carrying the toner fed from the developing container on the surface of the developing carrying member to form a toner layer, and conveying the toner, and a toner layer thickness controlling member controlling the thickness of the toner layer, wherein:

the toner comprises:

toner particles containing a binder resin and a colorant, and silica fine particles, a covering rate X1 of the surface of each of the toner particles covered with the silica fine particles determined by an X-ray electron spectroscope for chemical analysis (ESCA) is 40.0 area % or more and 75.0 area % or less, a diffusion index represented by Expression 1 satisfies Expression 2, $$\text{diffusion index}=X1/X2 \quad \text{(Expression 1)}$$

$$\text{diffusion index}\geq -0.0042\times X1+0.62, \quad \text{(Expression 2)}$$

where a theoretical covering rate with the silica fine particles is defined as X2; and wherein:

the developing carrying member comprises:

an electrically conductive substrate, an elastic layer, and a surface layer containing a urethane resin, and the urethane resin has a partial structure derived from a reaction of a polyisocyanate with a compound represented by Formula (1):

Formula (1)

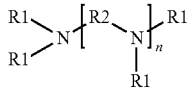

wherein n is an integer of 1 or more and 4 or less, and

R1 is each independently any one selected from the group consisting of (a) to (c):

(a) a hydroxyalkyl group having 1 or more and 8 or less carbon atoms, (b) an aminoalkyl group having 2 or more and 8 or less carbon atoms, and (c) a group represented by Formula (2):

Formula (2)

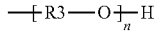

wherein m represents an integer of 2 or more and 3 or less, and R3 represents an alkylene group having 2 or more and 5 or less carbon atoms, and R2 represents an alkylene group having 2 or more and 4 or less carbon atoms.

2. The developing apparatus according to claim 1, wherein the compound represented by Formula (1) is represented by Formula (3):

Formula (3)

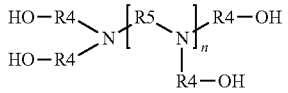

wherein n is 1 or 2,

R4 each independently represents an alkylene group having 2 or 3 carbon atoms, and R5 represents an alkylene group having 2 carbon atoms.

3. The developing apparatus according to claim 1, wherein the toner particles contain 0.40 parts by mass or more and 1.50 parts by mass or less of the silica fine particles based on 100 parts by mass of the toner particles.

4. A developing method comprising the step of:

conveying a toner with a developing carrying member to a region to be developed in an electrostatic latent image carrying member on which an electrostatic latent image is formed, and developing the electrostatic latent image with the toner in the region to be developed, wherein:

the toner comprises:

toner particles containing a binder resin and a colorant, and silica fine particles, a covering rate X1 of the surface of each of the toner particles covered with the silica fine particles determined by an X-ray electron spectroscope for chemical analysis (ESCA) is 40.0 area % or more and 75.0 area % or less, and a diffusion index represented by Expression 1 satisfies Expression 2, $$\text{diffusion index}=X1/X2 \quad \text{(Expression 1)}$$

$$\text{diffusion index} \geq -0.0042 \times X1+0.62, \quad \text{(Expression 2)}$$

where a theoretical covering rate with the silica fine particles is defined as X2; and wherein:

the developing carrying member comprises:

an electrically conductive substrate, an elastic layer, and a surface layer containing a urethane resin, and the urethane resin has a partial structure derived from a reaction of a polyisocyanate with a compound represented by Formula (1):

Formula (1)

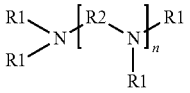

wherein n is an integer of 1 or more and 4 or less, R1 is each independently any one selected from the group consisting of (a) to (c):

(a) a hydroxyalkyl group having 1 or more and 8 or less carbon atoms, (b) an aminoalkyl group having 2 or more and 8 or less carbon atoms, and (c) a group represented by Formula (2):

Formula (2)

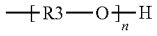

wherein m represents an integer of 2 or more and 3 or less, and R3 represents an alkylene group having 2 or more and 5 or less carbon atoms, and R2 represents an alkylene group having 2 or more and 4 or less carbon atoms.

5. An image forming apparatus comprising an image bearing member, and a developing apparatus developing an electrostatic latent image formed on the image bearing member, wherein the developing apparatus is the developing apparatus according to claim 1.

6. An image forming method, comprising:

a charging step of applying voltage to a charging member to charge an image bearing member, a step of forming a latent image on the charged surface of the image bearing member, a developing step of developing the electrostatic latent image with a toner carried on a developing carrying member to form a toner image, and a step of transferring the toner image onto a recording medium, wherein:

the developing step comprises the developing method according to claim 4.

* * * * *